US007038363B2

(12) United States Patent
Nunome

(10) Patent No.: US 7,038,363 B2
(45) Date of Patent: May 2, 2006

(54) SPARK PLUG WITH MARKING LAYER COMPOSITION

(75) Inventor: Kenji Nunome, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 119 days.

(21) Appl. No.: 10/746,379

(22) Filed: Dec. 29, 2003

(65) Prior Publication Data

US 2004/0135483 A1 Jul. 15, 2004

(30) Foreign Application Priority Data

Dec. 27, 2002 (JP) ..... P.2002-378843
Oct. 28, 2003 (JP) ..... P.2003-367879

(51) Int. Cl.
*H01T 13/20* (2006.01)

(52) U.S. Cl. ..... 313/143; 313/118; 313/137

(58) Field of Classification Search ..... 313/140, 313/141, 118, 130, 143, 137; 445/7
See application file for complete search history.

(56) References Cited

U.S. PATENT DOCUMENTS 6,492,289 B1 12/2002 Suzuki et al.
6,566,792 B1 * 5/2003 Nishikawa ..... 313/118
6,590,318 B1 7/2003 Nishikawa et al.
2002/0033659 A1 3/2002 Nishikawa et al.
2002/0041136 A1 4/2002 Nishikawa
2002/0067110 A1 6/2002 Nishikawa et al.

FOREIGN PATENT DOCUMENTS

| | | |
|---|---|---|
| EP | 1 168 545 A1 | 1/2002 |
| JP | 2001-39733 | 2/2001 |
| JP | 2001-203059 | 7/2001 |
| JP | 2001-244043 | 9/2001 |
| JP | 2002-15833 | 1/2002 |
| JP | 2002-175865 | 6/2002 |

OTHER PUBLICATIONS

European Search Report for EP 03 25 8224 dated Mar. 18, 2004.

* cited by examiner

*Primary Examiner*—Joseph Williams
*Assistant Examiner*—Kevin Quarterman
(74) *Attorney, Agent, or Firm*—Sughrue Mion, PLLC

(57) ABSTRACT

A spark plug comprising an insulator, on at least a part of a surface of the insulator being formed a marking layer and a glaze layer, wherein the marking layer is exposed on the surface of the insulator and has a composition as described herein.

10 Claims, 6 Drawing Sheets

SPARK PLUG WITH MARKING LAYER COMPOSITION

FIELD OF THE INVENTION

The present invention relates to a spark plug. In particular, the invention relates to a spark plug provided with an insulator on the surface of which is formed a design having a beautiful color.

BACKGROUND OP THE INVENTION

In general, a spark plug that is used for ignition of an internal combustion engine such as automobile engines has a structure where an insulator made of an alumina ceramic, etc. is disposed inside a metal shell installed with a ground electrode, and a center electrode is disposed inside the insulator. The insulator projects from the rear opening of the metal shell to the axial direction. A terminal metal fixture is disposed inside the projecting part of the insulator and is connected to the center electrode via a conductive glass seal that is formed in the glass sealing step. And a high voltage is applied to the terminal metal fixture to cause spark discharge over a gap formed between the ground electrode and the center electrode.

However, under some combined conditions where, for example, the temperature of the spark plug increases, and the circumferential temperature increases, it may happen that even when a high voltage is applied to the spark plug, normal discharge does not occur over the gap, but discharge occurs between the terminal metal fixture and the metal shell on the surface of the insulator to cause dielectric breakdown (this phenomenon will be hereinafter referred to as "flashover"). For that reason, in most of commonly used spark plugs, for the sake of mainly avoiding this flashover phenomenon, a glaze layer is formed on at least a part of the surface of the insulator. Also, the glaze layer serves to smoothen the insulator surface, thereby preventing contamination, and to enhance chemical or mechanical strength of the insulator.

In the case of alumina based insulators for spark plug, there have hitherto been used glazes of lead silicate glass where a silicate glass is compounded with a relatively large amount of PbO to lower the softening point. In recent years, however, glazes containing a Pb component have been losing acceptance from the standpoint of environmental protection. Then, for the sake of making a glaze leadless, there have been made various reviews.

As a background art, there is JP-A-2001-39733.

SUMMARY OF THE INVENTION

In addition to the foregoing glaze layer, a design comprising letters, signs and other images such as a manufacturer's name, a logo mark, and a product number is usually formed on the surface of an insulator of spark plug. A marking layer on which the design is formed is baked and formed by printing an ink having a color developing component compounded therein on the surface (or on the glaze layer) of the insulator and then baking the ink. And the marking layer is formed in either one of the mode of overglaze where the surface of the marking layer itself is exposed on the surface of the insulator after baking or the mode of underglaze where the surface of the marking layer itself is not exposed on the surface of the insulator after baking (for example, a glaze layer is further formed on the surface of the marking layer). Also, in the case where the marking layer is formed in the mode of underglaze, the marking layer is made in the visible state.

In any mode of overglaze or underglaze, the marking layer is required such that the surface is formed in the more smoothened state. When the smoothening is retarded, it will be retarded to form a desired design in the marking layer. Then, according to the conventional technologies, for the sake of forming a desired design, it was desired to smoothen the surface of the marking layer by containing a relatively large amount of a Pb component in an ink to be used in the marking layer. However, likewise the glaze layer, it is an important issue from the environmental protection to make the marking layer leadless.

Thus, for the sake of advancing the marking layer being made leadless, it is necessary to review the kinds and contents of components to be contained in the marking layer so as to secure at least smoothness of the surface of the marking layer even in the state where the content of the Pb component to be contained in the marking layer is reduced.

Further, the marking layer to be formed in the mode of overglaze is required to have a function to enhance the chemical or mechanical strength, which the glaze layer originally possesses. This is because even when an insulator is formed in the marking layer, this function serves to retard the strength of the insulator. Also, the marking layer is required to have a function to avoid flashover that the glaze layer possesses.

On review of the foregoing problems, the invention has been made. That is, an object of the invention is to provide spark plug in which even in the state where the content of a Pb component to be contained in a marking layer that is formed in the mode of overglaze is reduced, smoothness on the surface of the marking layer is secured, and the marking layer has functions of a glaze layer to enhance mechanical strength and to avoid flashover.

The spark plug of the invention for solving the foregoing problems is a spark plug comprising an insulator, on at least a part of the surface of the insulator being formed a marking layer and a glare layer, wherein the marking layer is exposed on the surface of the insulator and has a content of a Pb component of not more than 5% by mole in terms of PbO; a content of an Si component of from 36% by mole to 72% by mole in terms of $SiO_2$; a content of an Al component of from 0.1% by mole to 18% by mole in terms of $Al_2O_3$; a content of an alkali metal component containing at least one kind of an Li component, an Na component and a K component of from 0.1% by mole to 9% by mole in terms of $Li_2O$, $Na_2O$ and $K_2O$, respectively; a content of a B component of from 3% by mole to 30% by mole in terms of $B_2O_3$; and a content of a color developing component containing at least one kind of a V component, a Cr component, an Mn component, an Fe component, a Co component, an Ni component, a Cu component, a Pr component, an Nd component, an Au component, a Cd component, an Sn component, an Sb component, an Se component, an S component and an La component of more than 0% by mole but not more than 50% by mole in terms of $V_2O_5$, $Cr_2O_3$, $MnO_2$, $Fe_2O_3$, CoO, NiO, CuO, $Pr_2O_3$, $Nd_2O_3$, $Au_2O_3$, $Cd_2O_3$, $SnO_2$, $Sb_2O_5$, $SeO_2$, $SO_3$ and $La_2O_3$, respectively.

By making the content of the Pb component not more than 5% by mole in terms of PbO, the spark plug of the invention does not contain lead and hence, is suitable for environmental protection. On the other band, for the sake of reducing the content of the Pb component to not more than 5% by mole, it is necessary to design to smoothen the surface of the marking layer by other constitutional components than the Pb component.

Further, it may be said that the spark plug of the invention is characterized in that it can be usefully applied to the mode of overglaze, which is considered as a mode where the marking layer is exposed on the surface of the insulator after baking. In the marking layer formed in the mode of overglaze, since the appearance is directly viewed, it becomes possible to view the appearance in the more desired state. On the other hand, in the case where the marking layer is formed in the mode of overglaze, the marking layer is required to substitute functions that are required in the glaze layer. For that reason, the marking layer is required to secure the chemical or mechanical strength (hereinafter simply referred to as "strength") in the marking layer formed in the mode of overglaze or insulation against the flashover in addition to ensuring the smoothening.

Then, in the marking layer of the invention, not only the content of the PbO component is made not more than 5% by mole in terms of PbO, but also essential components and content ranges thereof are regulated from the reasons described below.

In the marking layer of the invention, an Si component as the glass component is contained in an amount of from 36% by mole to 72% by mole in terms of $SiO_2$. This Si component is a glass base in baking and forming the marking layer and plays a role to sufficiently secure the insulation of the marking layer. With respect to the content of the Si component playing such a role, when it is less than 36% by mole in terms of $SiO_2$, the effect for sufficiently securing the insulation may possible fail. On the other hand, when the content of the Si content exceeds 72% by mole, fluidity of particles in baking and forming the marking layer is retarded so that it becomes difficult to bake and form the marking layer. Taking into consideration these contents, the content of the Si content is regulated to fall within the range of from 36% by mole to 72% by mole.

Next, in the marking layer, an Al component is contained in an amount of from 0.1% by mole to 18% by mole in terms of $Al_2O_3$. This Al component plays a role to stabilize fluidity of particles in baking and forming the marking layer. For that reason, not only it is possible to expand the baking temperature region for baking and forming the marking layer, but also it is possible to minutely form the marking layer to be baked and formed with good sinterability. As a result, it becomes possible to sufficiently secure the strength of the marking layer. When the content of the Al component is less than 0.1% by mole in terms of $Al_2O_3$, the effect for minutely forming the marking layer cannot be sufficiently obtained so that the strength of the marking layer cannot be sufficiently secured. Also, the smoothness on the surface of the marking layer cannot be sufficiently secured. On the other hand, when the content of the Al component exceeds 18% by mole in terms of $Al_2O_3$, a color developing component for subjecting the marking layer to coloration cannot sufficiently play a role to cause coloration. For that reason, there are generated inconveniences such that the appearance color of the marking layer becomes dark and dull and that the appearance of the marking layer is viewed in the discolored state different from the desired color. Taking into consideration these contents, the content of the Al component is regulated to fall within the range of from 0.1% by mole to 18% by mole.

Next, in the marking layer, one or two or more kinds of an alkali metal component of an Li component, an Na component and a K component are contained in an amount of from 0.1% by mole to 9% by mole in terms of $Li_2O$, $Na_2O$ and $K_2O$, respectively. This alkali metal component plays a role to lower the softening point of the Si component as the glass component. For that reason, by containing the alkali metal component, not only it is possible to enhance fluidity of particles in baking and forming the marking layer, but also it is possible to make the surface of the marking layer to be baked and formed smoother. As a result, it becomes possible to sufficiently secure the smoothness on the surface of the marking layer. Then, when the content of the alkali metal component is less than 0.1% by mole in terms of $Li_2O$, $Na_2O$ and $K_2O$, respectively, it is impossible to sufficiently secure the smoothness on the surface of the marking layer. Further, it may possibly become difficult to bake the marking layer. On the other hand, when the content of the alkali metal component exceeds 9% by mole in terms of $Li_2O$, $Na_2O$ and $K_2O$, respectively, there is generated an inconvenience such that the insolation of the marking layer lowers. Taking into consideration these contents, the content of the alkali metal component is regulated to fall within the range of from 0.1% by mole to 9% by mole. Further, when the alkali metal component is added in the form of two or three kinds of the Li component, the Na component and the K component, it is possible to further enhance the smoothness of the marking layer.

Next, in the marking layer, a B component is contained in an amount of from 3% by mole to 30% by mole in terms of $B_2O_3$. Likewise the alkali metal component, the B component plays a role to lower the softening point of the Si component as the glass component. For that reason, by containing the B component, not only it is possible to enhance fluidity of particles in baking and forming the marking layer, but also it is possible to make the surface of the marking layer to be baked and formed smoother. As a result, it becomes possible to sufficiently secure the smoothness on the surface of the marking layer. Then, when the content of the B component is less than 3% by mole in terms of $B_2O_3$, the fluidity of particles in baking and forming the marking layer is retarded so that it is impossible to sufficiently secure the smoothness on the surface of the marking layer. Further, it may possibly become difficult to bake the marking layer. On the other hand, when the content of the B component exceeds 30% by mole in terms of $B_2O_3$, a color developing component for subjecting the marking layer to coloration cannot sufficiently play a role to cause coloration. Taking into consideration these contents, the content of the B component is regulated to fall within the range of from 3% by mole to 30% by mole.

In the invention, when the foregoing Si component, Al component, alkali metal component and B component are contained in the foregoing numerical value ranges, respectively, the conditions that are required for the making layer, such as smoothness, strength and insulation, are secured. Besides the foregoing components to be contained in the marking layer, the marking layer contains a color developing component for subjecting the marking layer to coloration. The color developing component includes at least one kind of a V component, a Cr component, an Mn component, an Fe component, a Co compon nt, an Ni component, a Cu component, a Pr component, an Nd component, an Au component, a Cd component, an Sn component, an Sb component, an Se component, an S component and an La component, and its content is more than 0% by mole but not more than 50% by mole in terms of $V_2O_5$, $Cr_2O_3$, $MnO_2$, $Fe_2O_3$, CoO, NiO, CuO, $Pr_2O_3$, $Nd_2O_3$, $Au_2O_3$, $Cd_2O_3$, $SnO_2$, $Sb_2O_5$, $SeO_2$, $SO_3$ and $La_2O_3$, respectively.

Each of the foregoing components as the foregoing color developing component is contained in the form of a composition of an oxide of the component, etc. in the marking layer. And the marking layer is viewed in the state corresponding to one of the colors defined according to JIS Z8102-1996.

Further, the kind of the color developing component to be contained in the marking layer is properly chosen corresponding to the color desired in subjecting the marking layer to coloration. Also, the composition comprising the respective components as the color developing component is not limited to the foregoing oxide formulations, but these oxide formulations are given for the sake of convenience for the purpose of regulating the content of the color developing component to be contained in the marking layer. And as the oxide formulation of the color developing component, there are different variables depending upon the valency that an element to be bound to oxygen can take. Also, for example, in the Au component, Au alone may be present without binding to oxygen. Even such cases, the kind of the oxide formulation of the color developing component is properly chosen corresponding to the color desired in subjecting the marking layer to coloration.

Next, the content of the color developing component to be contained in the marking layer is more than 0% by mole but not more than 50% by mole in terms of oxide formulation of each of the color developing components. In the marking layer, when the color developing component is at least contained, the marking layer causes coloration. Then, with respect to the upper limit of the content of the color developing component to be contained in the marking layer, when the color developing component is contained in an amount of 50% by mole, the resulting marking layer can sufficiently correspond to all of colors inclusive of black and their light and shade. Accordingly, the content of the color developing component to be contained in the marking layer is regulated to be more than 0% by mole but not more than 50% by mole.

Next, the marking layer of the invention is characterized by containing at least one kind of a first alkaline earth metal component of an Mg component and a Ca component.

By containing at least one kind of the first alkaline earth metal component of an Mg component and a Ca component in the marking layer, insulation of the marking layer can be further enhanced. In particular, when a Ca component is essential in the first alkaline earth metal component, the insulation of the marking layer can be further enhanced. Especially, it is desired that the content of the first alkaline earth metal component is not more than 20% by mole in terms of MgO and CaO, respectively. When the content of the first alkaline earth metal component exceeds the upper limit, the softening point of the Si component as the glass component to be contained in the marking layer excessively increases so that it may possibly become difficult to bake the marking layer in the state where sinterability is sufficiently secured or it may possibly become difficult to bake the marking layer itself. Here, if the sinterability of the marking layer after baking is not sufficiently secured, there is generated an inconvenience such that the appearance of the marking layer is viewed in the dark and dull color state.

Next, the marking layer of the invention is characterized by containing at least one kind of a color development accelerating component of a Ti component and a Zr component.

By containing at least one kind of the color development accelerating component of a Ti component and a Zr component in the marking layer, it is possible to bake and form the color developing component in the more stable state. As a result, it is possible to make the appearance color of the marking layer that is subjected to coloration by the color developing component have good gloss and good color state without causing the dark and dull color state. In particular, it is desired that the content of the color development accelerating component is not more than 42% by mole in terms of $TiO_2$ and $ZrO_2$, respectively, When the content of the color development accelerating component exceeds the upper limit, there is generated an inconvenience such that the appearance of the marking layer cannot be viewed in the desired color state.

Next, the marking layer of the invention is characterized by containing a Zn component. By containing a Zn component in the marking layer, it is possible to further smoothen the surface of the marking layer. In particular, it is desired that the content of the Zn component having such an effect is not more than 10% by mole in term of ZnO. When the content of the Zn component exceeds the upper limit, there may possibly be generated an inconvenience such that the appearance color of the marking layer is poor in gloss and becomes dark and dull.

Next, the marking layer of the invention is characterized by containing at least one kind of a second alkaline earth metal component of an Sr component and a Ba component.

By containing at least one kind of the second alkaline earth metal component of an Sr component and a Ba component in the marking layer, insulation of the marking layer can be further enhanced. In particular, it is desired that the content of the second alkaline earth metal component having such an effect is not more than 2% by mole in terms of SrO and BaO, respectively. When the content of the second alkaline earth metal component exceeds the upper limit, the strength of the marking layer may possibly lower.

Incidentally, as a matter of course, the respective effects of the foregoing first alkaline earth metal component, second alkaline earth metal component, Zn component and color development accelerating component are obtained when they are contained in the marking layer. Accordingly, needless to say, the content of each of the components is more than 0% by mole in terms of the oxide.

The spark plug may be provided with a design of a pattern constructed of a plurality of colors by combining two or more kinds of the marking layer having a different color from each other. Thus, it is possible to provide the spark plug with a design comprising letters, signs and other images such as a manufacturer's name, a logo mark, and a product number by plural colors and to give the spark plug a sharp tint. Incidentally, as described previously, the kind of the color developing component to be contained in the marking layer and the kind of the oxide formulation thereof are properly chosen corresponding to the desired color in subjecting the marking layer to coloration.

A general front cross-sectional view showing one example of the spark plug of the invention.

[FIG. 2]

A front view showing one formation mode of a marking layer to be formed on the surface of an insulator as an appearance of the insulator.

[FIG. 3]

An explanatory view of the formation step of a coated layer of glaze slurry.

[FIG. 4]

An explanatory view of the formation step of a printing layer.

[FIG. 5 (FIGS. 5A, 5B, 5C and 5D)]

An explanatory view of the glass sealing step.

Figure 6A:
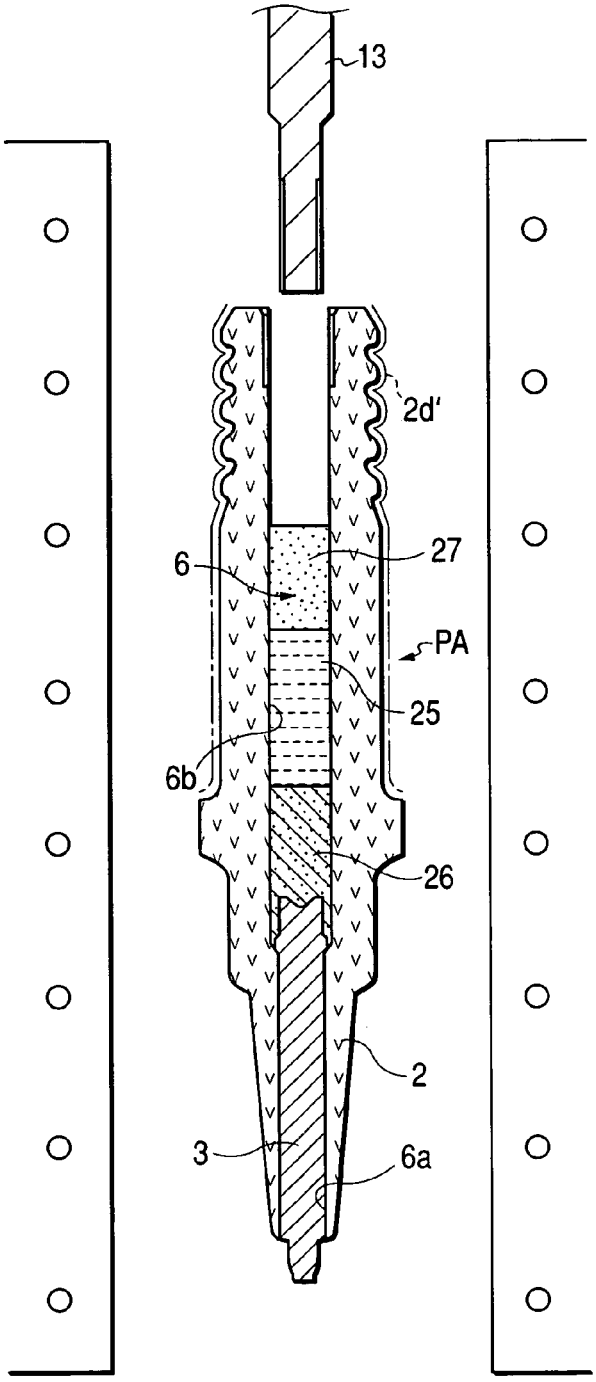
Figure 6B:
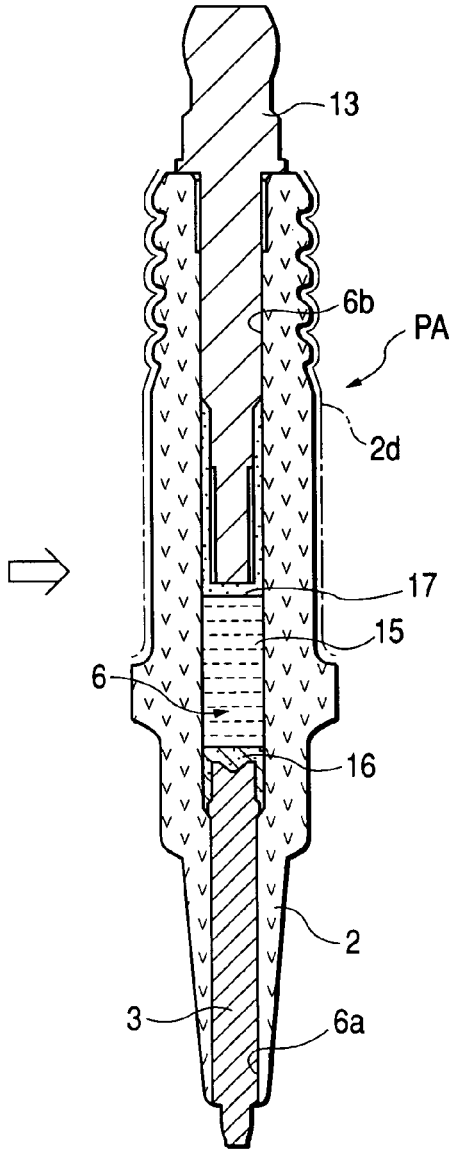

[FIG. 6 (FIGS. 6A and 6B)]

An explanatory view next to FIG. 5.

[FIG. 7]

An explanatory drawing for explaining the formation mode of a marking layer in the Example.

DESCRIPTION OF REFERENCE NUMERALS AND SIGNS

| | |
|---|---|
| 1: | Metal shell |
| 2: | Insulator |
| 2d: | Glaze layer |
| 2m: | Marking layer |
| 3: | Center electrode |
| 4: | Ground electrode |
| 100: | Spark plug |

DETAILED DESCRIPTION OF THE INVENTION

Modes for carrying out the invention will be described below with reference to some embodiments illustrated in the drawings.

Figure 1:
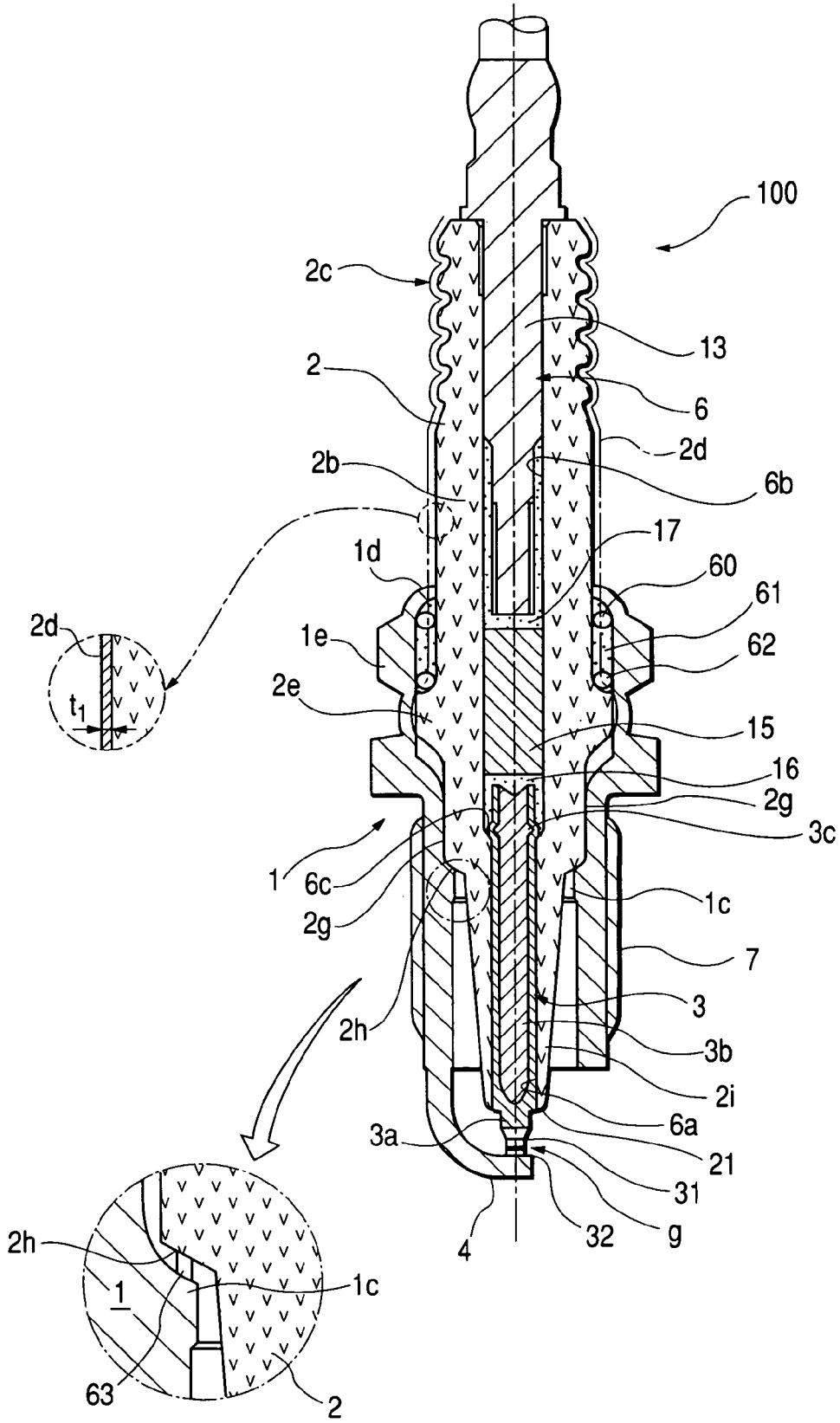
[FIG. 1]

FIG. 1 shows one embodiment of the spark plug according to the invention. The spark plug 100 has a cylindrical metal shell 1, an insulator 2 fitted in the inside of the metal shell 1 such that its tip 21 projects, a center electrode 3 disposed inside the insulator 2 in the state where an ignition part 31 formed at the tip thereof projects, and a ground electrode 4 such that its one end is bound to the metal shell 1 by weans of welding, etc., and the other end is bout inward, whereby its side face is opposed to the tip of the center electrode 3. Also, in the ground electrode 4, an ignition part 32 is formed opposing to the ignition part 31, and a space between the ignition part 31 and the opposing ignition part 32 is made a spark discharge gap g.

The metal shell 1 is formed to be cylindrical of a metal such as low carbon steel and has a thread 7 for constituting a housing of the spark plug 100 and installing the spark plug 100 into an engine block (not shown) in the outer peripheral surface thereof. Incidentally, a numeral 1*e* is a tool engaging part for engaging a tool such as a spanner and a wrench in installing the metal shell 1 and has a hexagonal axial cross-section.

Also, a through-hole 6 is formed in the axial direction of the insulator 2. A terminal metal fixture 13 is fixed in one end of the through-hole 6, and the center electrode 3 is fixed to the other end thereof. Also, a resistor 15 is disposed between the terminal metal fixture 13 and the center electrode 3 in the through-hole 6. The both ends of the resistor 15 are electrically connected to the center electrode 3 and the terminal metal fixture 13 via conductive glass seal layers 16, 17, respectively. The resistor 15 and the conductive glass seal layers 16, 17 constitute a conductive sintered body. Incidentally, the resistor 15 is constituted of a resistor composition obtained by heating and pressing a mixed powder as a raw material of a glass powder and a conductive material powder (and a ceramic powder other than the glass, if desired) in a glass sealing step as described later. Incidentally, the resistor 15 may be omitted, and the terminal metal fixture 13 and the center electrode 3 may be integrated with each other by a conductive glass seal layer as one layer.

The insulator 2 has the through-hole 6 for fitting the center electrode 3 therein along the axial direction thereof, and the whole is constituted of the following insulating material. That is, the insulating material is composed mainly of alumina and is constituted of an alumina based ceramic sintered body having an Al component of from 85 to 98% by weight (desirably from 90 to 98% by weight) in terms of $Al_2O_3$.

As the specific formulation of components other than the Al component, those described blow are enumerated.

| | |
|---|---|
| Si component: | from 1.50 to 5.00% by weight in terms of $SiO_2$ |
| Ca component: | from 1.20 to 4.00% by weight in terms of CaO |
| Mg component: | from 0.05 to 0.17% by weight in terms of MgO |
| Ba component: | from 0.15 to 0.50% by weight in terms of BaO |
| B component: | from 0.15 to 0.50% by weight in terms of $B_2O_3$ |

Figure 2:
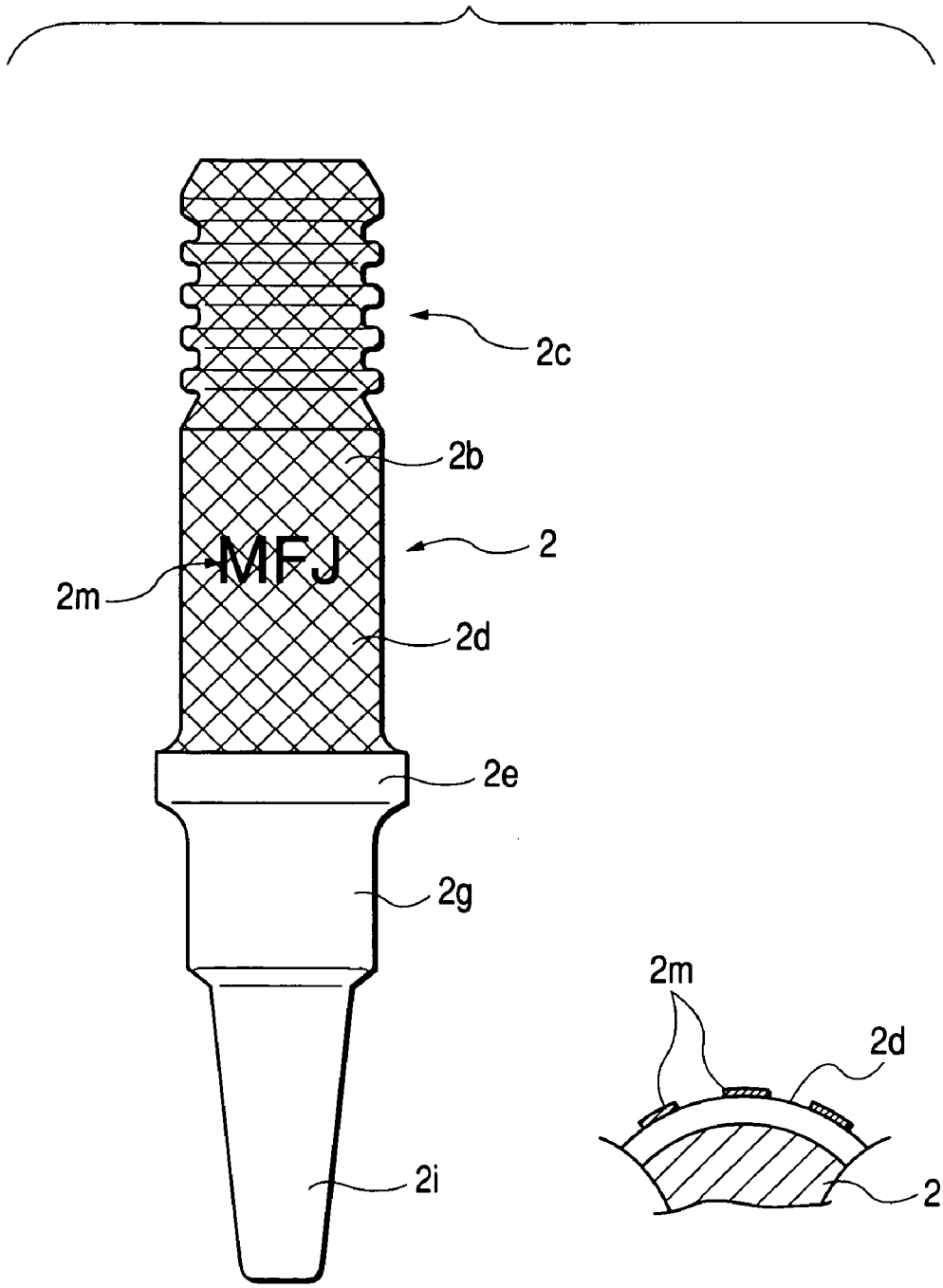

FIG. 2 is one where only the insulator 2 is taken out. A projecting portion 2*e* projecting outwardly in the periphery direction is, for example, formed in the flange-like state in the middle of the axial direction of the insulator 2. And a main body portion 2*b* whose front side is forwarding the tip of the center electrode (FIG. 1) and whose rear side has an outer diameter smaller than the projecting portion 2*e* is formed. on the other hand, in the front side of the projecting portion 2*e*, a first axial portion 2*g* whose outer diameter is smaller than the projecting portion 2*e* and a second axial portion 2*i* whose outer diameter is smaller than the first axial portion 2*g* are formed in that order. Incidentally, a corrugation portion 2*c* is formed in rear end part of the outer peripheral surface of the main body portion 2*b*. Also, the outer peripheral surface of the first axial portion 2*g* is substantially cylindrical, and the second axial portion 2*i* is substantially conical such that it is tapered toward the tip.

Turning back to FIG. 1, the center electrode 3 is set up so as to have an axial cross-sectional diameter smaller than that of the resistor 15. And the through-hole 6 of the insulator 2 has a substantially cylindrical first portion 6*a* into which the center electrode 3 is inserted and a substantially cylindrical second portion 6*b* formed in the rear side (upper side of FIG. 1) of the first portion 6*a* and having a diameter larger than that of the first portion 6*a*. The terminal metal fixture 13 and the resistor 15 are disposed in the second portion 6*b*, and the center electrode 3 is inserted into the first portion 6*a*. In the rear end part of the center electrode 3, an electrode-fixing convex portion 3*c* is formed projecting outwardly from the outer peripheral surface of the center electrode 3. The first portion 6*a* and the second portion 6*b* of the through-hole 6 are connected to each other in the first axial portion 2*g*, and at the connecting position, a convex receiving face 6*c* for receiving the electrode-fixing convex portion 3*c* of the center electrode 3 is formed in a tapered or rounded form.

Also, a level difference is formed on the outer peripheral surface of a connecting part 2*h* between the first axial portion 2*g* and the second axial portion 2*i*. The connecting part 2*h* is engaged with a convex portion 1*c* as a metal shell side engaging part formed on the inner face of the metal shell 1 via a ring-like plate packing 63, thereby preventing slipping in the axial direction. On the other hand, a ring-like wire packing 62 that is engaged with the rear side surrounding of the flange-like protecting portion 2*e* is disposed between the inner face of the rear side opening of the metal shell 1 and the outer face of the insulator 2, and a ring-like wire packing 60 is disposed in the rear side of the wire packing 62 via a filling layer 61 made of talc, etc. And the insulator 2 is inserted into the metal shell 1 toward the front side, and under this condition, the opening edge of the metal shell 1 is caulked inward the packing 60 to form a caulking portion 1*d*, and the metal shell 1 is secured to the insulator 2.

Next, as shown in FIG. 2, a glaze layer 2*d* is formed on the surface of the insulator 2, concretely the outer peripheral surface of the main body portion 2*b* including the corrugation portion 2*c* and the outer peripheral surface of the first axial portion 2*g*. Incidentally, as shown in FIG. 1, the glaze layer 2*d* formed in the main body portion 2*b* is formed such that its front side in the axial direction enters the inside of the metal shell 1 to a prescribed length, whereas its rear side extends to the rear edge position of the main body portion 2*b*.

As the components to be contained in the glaze layer 2*d*, ones that are known from JP-A-2001-244043 can be used. For example, when the glaze layer 2*d* is constructed of from 35 to 80% by mole of a first component comprising from 5 to 60% by mole of an Si component in terms of $SiO_2$ and from 3 to 50% by mole of a B component in terms of $B_2O_3$ and a second component comprising at least one kind of of a Zn component and an alkaline earth metal component R (wherein R is one or two or more kinds selected from Ca, Sr and Ba) in an amount of from 5 to 60% by mole in terms of ZnO for the Zn component and RO for the alkaline earth metal component R, respectively, with the sum of the first component and the second component being from 65 to 98% by mole and additionally, at least one kind of an alkali metal component selected from an Na component, a K component and an Li component in a total amount of from 2 to 15% by mole in terms of $Na_2O$, $K_2O$ and $Li_2O$, respectively, it is possible to make the glaze layer 2*d* leadless such that the content of Pb component contained in the glaze layer 2*d* is reduced to not more than 5% by mole. Thus, among these known materials, one that has been made leadless is used as the glaze layer 2*d*.

Also, the glaze layer 2*d* to be formed has a thickness of, for example, from about 7 to 150 μm, and preferably from 10 to 50 μm. In particular, the glaze layer 2*d* has a thickness t1 (average value) of from 7 to 50 μm on the outer peripheral surface of the base end portion of the main body portion 2*b* of the insulator (the cylindrical outer peripheral portion to which the corrugation portion 2*c* is not imparted projecting backward from the metal shell 1).

Next, as shown in FIG. 2, a marking layer 2*m* is formed in the mode of overglaze such that it comes into contact with the surface of the glaze layer 2*d* formed on the surface of the insulator 2 in the main body portion 2*b*. In the marking layer 2*m* formed in the mode of overglaze, since its appearance is directly viewed, the appearance can be viewed in the more desired state. And in the marking layer 2*m* having such a formation mode, the content of the Pb component is made not more than 5% by mole in terms of PbO, for example, 0% by mole where the Pb component is not contained. On the other hand, in the case where the marking layer 2*m* is formed in the mode of overglaze, it is required to substitute functions that are required in the glaze layer 2*d*. Then, the marking layer 2*m* contains an Si component in an amount of from 36% by mole to 72% by mole in terms of $SiO_2$, an Al component in an amount of from 0.1% by mole to 18% by mole in terms of $Al_2O_3$, one or two or more kinds of an alkali metal component of an Li component, an Na component and a K component in an amount of from 0.1% by mole to 9% by mole in terms of $Li_2O$, $Na_2O$ and $K_2O$, respectively, and a B component in an amount of from 3% by mole to 30% by mole in terms of $B_2O_3$. The marking layer 2*m* containing these components as essential components can serve to sufficiently secure various conditions such as smoothness, strength, and insulation contributing to prevention of a flashover phenomenon.

Further, the marking layer 2*m* contains, as a color developing component for subjecting the marking layer 2*m* to coloration to a desired color, at least one kind of a V component, a Cr component, an Mn component, an Fe component, a Co component, an Ni component, a Cu component, a Pr component, an Nd component, an Au component, a Cd component, an Sn component, an Sb component, an Se component, an S component and an La component in an amount of more than 0% by mole but not more than 50% by mole in terms of $V_2O_5$, $Cr_2O_3$, $MnO_2$, $Fe_2O_3$, CoO, NiO, CuO, $Pr_2O_3$, $Nd_2O_3$, $Au_2O_3$, $Cd_2O_3$, $SnO_2$, $Sb_2O_5$, $SeO_2$, $SO_3$ and $La_2O_3$, respectively. Each of the components as the color developing component is viewed in a color inherent thereto, and at least one kind of these components as the color developing component is properly chosen according to the desired color in subjecting the marking layer 2*m* to coloration.

Also, the marking layer 2*m* is provided with a design comprising letters, signs and other images such as a manufacturer's name, a logo mark, as in the letters shown in FIG. 2. Also, in subjecting the marking layer 2*m* to coloration, for example, in the case where it is intended to subject the letter M of three letters in FIG. 2 to coloration to a color different from other letters, the marking layer 2*m* may be constructed of a marking layer on which the letter M (design) is formed and a marking layer on which other letters (design) are formed, the both marking layers having a different color from each other. By properly choosing and combining two or more kinds of the marking layer 2*m* having a different color from each other, it is possible to provide the spark plug with a design constituted of plural colors and to make the three letters in the marking layer 2*m* have a sharp tint. While the marking layer 2*m* has been described with reference to the case where the design is composed of letters, the invention is not limited thereto. For example, even in the case where the design is composed of an image, by combining two or more kinds of the marking layer having a different color from each other, it is possible to form an image (design) having a sharp tint.

The marking layer 2*m* to be formed has a thickness of, for example, from about 1 to 10 μm. Not limiting to the marking layer 2*m*, when the thickness of the marking layer to be formed is less than 1 μm the color of the undercoat layer against the marking layer as the glaze layer in the mode of overglaze is transparent and is liable to be viewed. On the other hand, when the thickness of the marking layer to be formed exceeds 10 μm, unevennesses are likely generated on the surface of the marking layer. As a result, not only the smoothness of the surface of the marking layer is retarded, but also it is retarded to view the appearance of the marking layer in the desired state. Taking into consideration these contents, it is desired that the thickness of the marking layer to be formed falls within the range of from 1 to 10 μm. Accordingly, it is desired that the thickness of the marking layer 2*m* falls within the range of from 1 to 10 μm.

Here, the content of each of the components contained in the marking layer 2*m* and the glaze layer 2*d* formed on the insulator 2 can be identified using known microprobe analysis methods such as EPMA (electron probe microanalysis) and XPS (X-ray photoelectron spectroscopy). For example, in the case of using EPMA, any of wavelength dispersion mode and energy dispersion mode may be employed for measurement of specific X-rays. Also, a method of formulation identification of the marking layer 2*m* or the glaze layer 2*d* separated from the insulator 2 by chemical analysis or gas analysis is employable.

The softening point of the making layer 2*m*, i.e., the softening point of the Si component as the glass component to be contained in the marking layer 2*m*, may be adjusted within the range of, for example, not higher than 700° C. When the softening point exceeds 700° C., it becomes difficult to bake the marking layer 2*m* in the state where the sinterability is sufficiently secured, and in its turn, it becomes impossible to bake the marking layer 2*m* at the desired baking temperature. Incidentally, the softening point of the marking layer as referred to herein means a temperature at which, when the marking layer 2*m* is separated from the insulator 2 and subjected to differential thermal analysis while heating, a peak next to a first endothermic peak exhibiting the softening point (that is, a secondly occurred endothermic peak) appears. Also, with respect to the softening point of the marking layer 2*m* formed on the surface of the marking layer 2*m*, it is also possible to estimate the softening point of the marking layer 2*m* to be formed based on the softening point of a glass sample prepared by analyzing the content of each of the components contained in the marking layer 2*m*, calculating a formation in terms of its oxide, and compounding and dissolving oxide raw materials of the respective element components to be oxidized, followed by quenching.

Next, as shown in FIG. 1, the ground electrode 4 and a main body portion 3*a* of the center electrode 3 are made of an Ni alloy, etc., on which ignition parts 31, 32 mainly made of a noble metal alloy based on one or two or more kinds of Ir, Pt and Rh are formed by welding, etc. Also, the main body portion 3*a* of the center electrode 3 is buried inside with a core 3*b* made of Cu or a Cu alloy, etc. for the purpose of accelerating heat dissipation. Incidentally, at least one of the ignition part 31 and the opposing ignition part 32 may be omitted.

The spark plug 100 can be, for example, produced by the following method. First of all, in preparing the insulator 2, an alumina powder is compounded with raw material powders of an Si component, a Ca component, an Mg component, a Ba component and a B component in a prescribed ratio so as to have the foregoing formulation in terms of each oxide after baking, and prescribed amounts of a binder (such as PVA) and water are added to and compounded with the mixture to prepare a basis slurry for molding. Incidentally, the respective raw material powders can be compounded in the form of an $SiO_2$ powder for the Si component, a $CaCO_3$ powder for the Ca component, an MgO powder for the Mg component, a $BaCO_3$ or $BaSO_4$ powder for the Ba component, and an $H_3BO_3$ powder for the B component, respectively. Incidentally, $H_3BO_3$ may be compounded in the form of a solution.

The basis slurry for molding is spray dried by spray drying, etc. to form basis granules for molding. The basis granules for molding are rubber-pressed to prepare a press molding as a prototype of the insulator. The molding is further processed on the outer side by grinding, etc. to a contour corresponding to the insulator 2 shown in FIG. 2 and then baked at a temperature of from 1,400 to 1,600° C. to obtain the insulator 2.

Next, the formation step of forming the marking layer 2*m* and the glaze layer 2*d* on the surface of the formed insulator 2 will be described below. First of all, a glaze slurry is prepared as follows. Raw materials powders as sources of an Si component, a B component, a Zn component, a Ba component, and an alkali metal component (such as an Na component, a K component, and an Li component) (for example, an $SiO_2$ powder for the Si component, an $H_3BO_3$ powder for the B component, a ZnO powder for the Zn component, a $BaCO_3$ or $BaSO_4$ powder for the Ba component, an $Na_2CO_3$ powder for the Na component, a $K_2CO_3$ powder for the K component, and an $Li_2CO_3$ powder for the Li component) are compounded and mixed so as to obtain a prescribed formulation. Next, the mixture is heated and melted at from 1,000 to 1,500° C., and the melt is thrown into water and quenched for vitrification, followed by pulverization to prepare a glaze frit. The glaze frit is compounded with proper amounts of clay minerals (such as kaolin and gairome clay) and an organic binder, and water is further added to and mixed with the mixture to obtain a glaze slurry.

Figure 3:
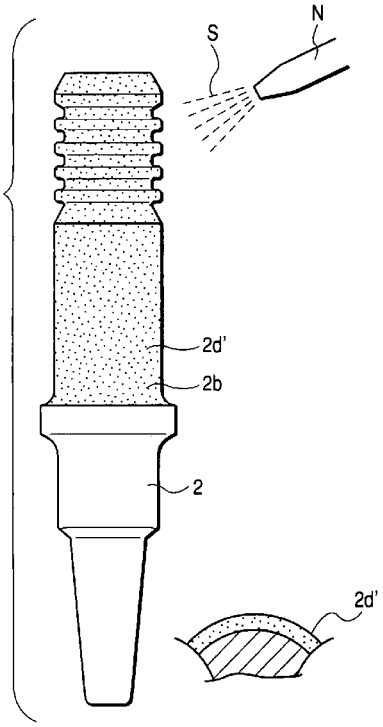

And as shown in FIG. 3, a glaze slurry S is sprayed and coated on the required surface of the insulator 2 from a spray nozzle N, to form a coated layer 2*d*' of the glaze slurry as a piled layer of the glaze powder, followed by drying.

Figure 4:
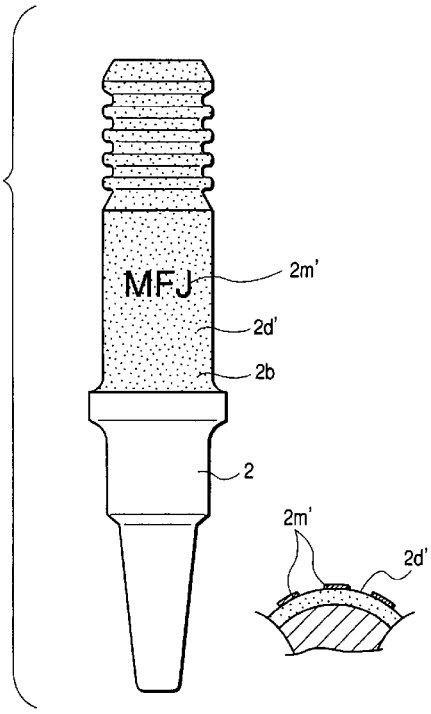

Next, as shown in FIG. 4, a printing layer 2*m*' for forming the marking layer is formed on the surface of the coated layer 2*d*' of the glaze slurry. As inks for printing, ones in which raw material oxide powders of the components to be contained in the marking layer, at least containing at least one kind of the foregoing color developing components as a pigment and the essential components to be contained in the marking layer, are compounded with a solvent and an organic binder or a viscosity modifier, etc. can be used. Also, in the ink, the kinds and compound ratio of the raw material oxide powders to be compounded are properly chosen and adjusted, and the content of each of the components to be contained in the marking layer and the kinds of color developing components corresponding to the desired color in coloration of the marking layer and the kind of valency of the composition of the color developing components are properly chosen and adjusted. Then, the marking layer is formed on the surface of the coated layer 2*d*' of the glaze slurry using this ink, thereby printing a pattern as the desired design. Also, in printing this pattern, by combining two or more kinds of the marking layer having a different color from each other, it is possible to form a design of a pattern comprising plural colors.

Incidentally, it is desired that the raw material oxide powder particles used when compounded in the ink are adjusted to have a mean particle size in the range of from 0.3 to 2.0 μm. When the mean particle size is less than 0.3 μm, diffusion of the color developing component into the glaze layer 2*d* is liable to occur so that the color to be viewed likely causes inconveniences such as bleeding. On the other hand, when the mean particle size exceeds 2 μm, the viscosity of the ink becomes excessively high so that the coating thickness of the printing layer 2*m*' becomes likely uneven.

Figure 5D:
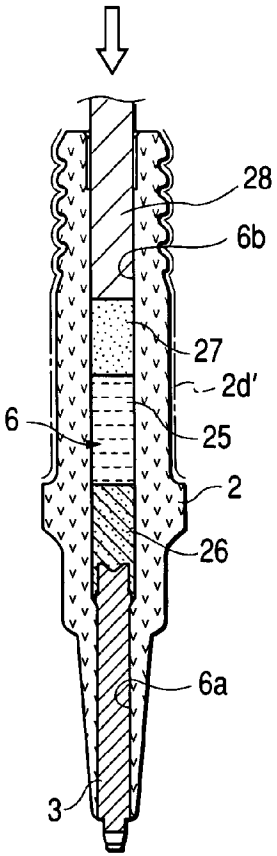
Figure 5C:
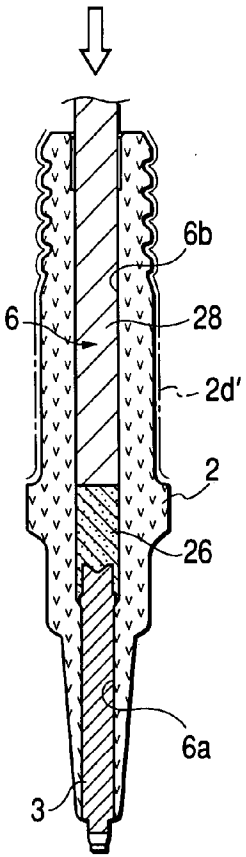
Figure 5B:
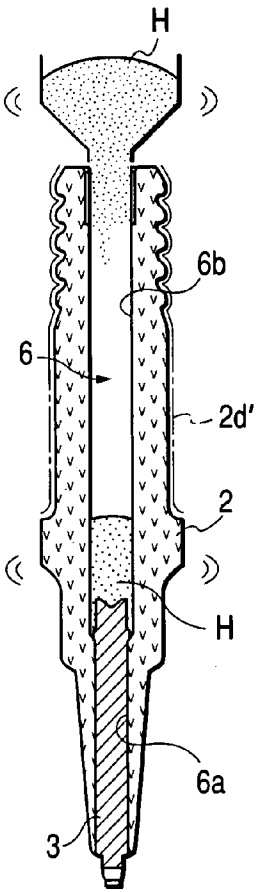
Figure 5A:
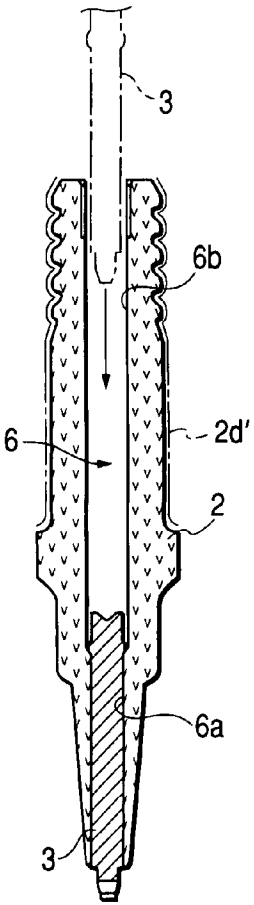

Next, outlines of a fitting step of the center electrode 3 and the terminal metal fixture 13 in the insulator 2 on which the coated layer 2*d*' of the glaze slurry and the printing layer 2*m*' are formed and a formation step of the resistor 15 and the conductive glass seal layers 16, 17 are as follows. First of all, the center electrode 3 is inserted into a first portion 6*a* of the through-hole 6 of the insulator 2 as shown in FIG. 5A. Then, a conductive glass powder H is filled in the through-hole 6 as shown in FIG. 5B. And the filled powder H is preliminarily compressed by inserting a press bar 28 into the through-hole 6 to form a fist conductive glass powder layer 26 as shown in FIG. 5C. Next, a raw material powder of resistor composition is filled and preliminarily compressed in the same manner, and a conductive glass powder is further filled and preliminarily compressed. Thus, as shown in FIG. 5D, the first conductive glass powder layer 26, a resistor composition powder layer 25, and a second conductive glass powder layer 27 are laminated in the through-hole 6 from the side of the center electrode 3 (lower side).

And as shown in FIG. 6A, an assembled structure PA is formed where the terminal metal fixture 13 is disposed in the through-hole 6 from the upper part. The assembled structure PA is inserted into a heating furnace as it is and heated at a prescribed temperature of from 800 to 1,200° C., which is higher than the glass softening point. Thereafter, the terminal metal fixture 13 is inserted under pressure into the through-hole 6 in the axial direction from the side opposite to the center electrode 3, thereby pressing the respective layers 25 to 27 in the laminated state in the axial direction. Thus, as shown in FIG. 6B, the layers are each compressed and sintered to become the conductive glass seal layer 16, the resistor 15 and the conductive glass seal layer 17, respectively. This is an outline of the glass sealing step.

Here, when the softening point of the Si component as the glass component to be contained in the printing layer 2*m*' is set up at from 600 to 700° C., and the softening point of the glaze frit to be contained in the coated layer 2*d*' of the glaze slurry is set up at from 600 to 700° C., it is possible to bake and form the marking layer 2*m* and the glaze layer 2*d* by simultaneously baking the printing layer 2*m*' and the coated layer 2*d* of the glaze slurry upon heating in the glass sealing step. Incidentally, the softening point of the glaze frit is lower than the softening point of the Si component. In the case where the softening point of the glaze frit is higher than the softening point of the Si component, the printing layer is first baked in baking, whereby bleeding occurs in the marking layer. Also, by employing a relative low temperature of from 800 to 950° C. as the heating temperature in the glass sealing step, oxidation to the surfaces of the center electrode 3 and the terminal metal fixture 13 hardly occurs. Incidentally, the solvent and organic components in the printing layer 2*m*' are removed by evaporation or burning in the baking step. The coated layer 2*d*' of the glaze slurry is melted as the baking advances, whereby it becomes the transparent glass-like glaze layer 2*d*, and the marking layer 2*m* becomes in the state where the appearance can be explicitly viewed.

After completion of the glass sealing step, the metal shell 1, the ground electrode 4 and others are fitted on the assembled structure PA to complete the spark plug 100 shown in FIG. 1. The spark plug is installed in an engine block using the thread 7 and used as a source to ignite an air-fuel mixture to be supplied to a combustion chamber.

Though the foregoing step is a step of forming the marking layer 2*m* and the glaze layer 2*d* in the mode of overglaze shown in FIG. 2 by simultaneously baking the printing layer 2*m*' and the coated layer 2*d*' of the glaze slurry, in the case where the marking layer 2*m* is formed in the node of overglaze, it can also be formed according to the following step other than the foregoing step. First of all, the coated layer 2*d*' of the glaze slurry is formed on the surface of the insulator 2 in the same manner. Thereafter, the insulator 2 is heated at a temperature higher than the glass softening point of the glaze frit to be contained in the coated layer 2*d*' of the glaze slurry and baked such that the coated layer 2*d*' of the glaze slurry becomes the glaze layer 2*d*. Next, a pattern as the desired design in the marking layer is printed on the surface of the glaze layer 2*d* using the ink as described previously, and the printing layer 2*m*' is coated and formed. Thereafter, it is possible to form the marking layer 2*m* and the glaze layer 2*d* in the mode of overglaze shown in FIG. 2 through the same step as described previously.

EXAMPLES

For confirmation of the effects according to the invention, the following experiments were carried out.

Example 1

The insulator 2 was prepared as follows. First of all, as raw material powders, an alumina powder (alumina content: 95% by weight, content of Na component (in terms of $Na_2O$): 0.1% by weight, mean particle size: 3.0 μm) was compounded with $SiO_2$ (purity: 99.5%, man particle size: 1.5 μm), $CaCO_3$ (purity: 99.9%, mean particle size: 2.0 μm), MgO (purity: 99.5%, mean particle size: 2 μm), $BaCO_3$ (purity: 99.5%, mean particle size: 1.5 μm), $H_3BO_3$ (purity: 99.0%, mean particle size: 1.5 μm), and ZnO (purity: 99.5%, mean particle size; 2.0 μm) at prescribed ratios. One hundred parts by weight of the thus compounded powder mixture was wet mixed with 3 parts by weight of PVA as a hydrophilic binder and 103 parts by weight of water to prepare a basis slurry for molding.

Next, the slurries having a different formulation were each dried by spray drying to prepare spherical basis granules for molding. Incidentally, the granules were sieved to adjust the particle size to from 50 to 100 μm. The granules were molded under a pressure of 50 MPa by the rubber pressing method. The peripheral surface of the resulting molding was machined into a prescribed insulator shape using a grinder, and the molding was baked at a temperature of 1,550° C. to obtain the insulator 2. Incidentally, fluorescent X-ray analysis revealed that the insulator 2 bad the following formulation.

| | |
|---|---|
| Al component: | 94.9% by weight in terms of $Al_2O_3$ |
| Si component: | 2.4% by weight in terms of $SiO_2$ |
| Ca component: | 1.9% by weight in terms of CaO |
| Mg component: | 0.1% by weight in terms of MgO |
| Ba component: | 0.4% by weight in terms of BaO |
| B component: | 0.3% by weight in terms of $B_2O_3$ |

Next, the glaze slurry was prepared as follows. First of all, as raw materials, an $SiO_2$ powder (purity: 99.5%), an $Al_2O_3$ powder (purity: 99.5%), an $H_3BO_3$ powder (purity: 98.5%), an $Na_2CO_3$ powder (powder: 99.5%), a $K_2CO_3$ powder (purity: 99%), an $Li_2CO_3$ powder (purity: 99%), a $BaSO_4$ powder (purity: 99.5%) a ZnO powder (purity: 99.5%) an $MoO_3$ powder (purity: 99%), a CaO powder (purity: 99.5), a $TiO_2$ powder (purity: 99.0%) a $ZrO_2$ powder (purity: 99.5%), and an MgO powder (purity: 99.5%) were compounded at various ratios, and the mixture was heated and melted at from 1,000 to 1,500° C. The melt was thrown into water and quenched for vitrification, followed by pulverization in an alumina pot mill into a particle size of not larger than 50 μm, to prepare a glaze frit. One hundred parts by weight of the glaze frit was compounded with 3 parts by weight of New Zealand kaolin as a clay mineral and 2 parts by weight of PVA as an organic binder, to which was further added 100 parts by weight of water to obtain a glaze slurry. Incidentally, using a glaze sample prepared by solidifying the glaze slurry in a block form, chemical formulation of the glaze corresponding to the glaze frit was analyzed. The analysis results were as follows.

(Glaze Formulation)

| | |
|---|---|
| $SiO_2$: | 28.5% by mole |
| $B_2O_3$: | 28.5% by mole |
| ZnO: | 15.8% by mole |
| BaO: | 5.5% by mole |
| $Na_2O$: | 2.2% by mole |
| $K_2O$: | 5.4% by mole |
| $Li_2O$: | 3.0% by mole |
| $Al_2O_3$: | 2.4% by mole |
| $MoO_3$: | 0.5% by mole |
| $ZrO_2$: | 1.2% by mole |
| MgO: | 1.1% by mole |
| $TiO_2$: | 0.7% by mole |
| CaO: | 3.3% by mole |

Next, inks for forming the marking layer having a varied formulation were prepared as follows. Oxide raw materials were compounded so as to have the respective formulations and amounts shown in Table 1 (No. 1 to No. 46), and each of the mixtures was calcined at from 500 to 1,000° C., followed by pulverizing into a mean particle size of not larger than 1 μm in a trommel mill or agate mortar. Thereafter, proper amounts of a varnish and an alkyd resin or wax were added to and mixed with the pulverized powder, and the mixture was kneaded in a roll mill to obtain an ink.

Figure 7:
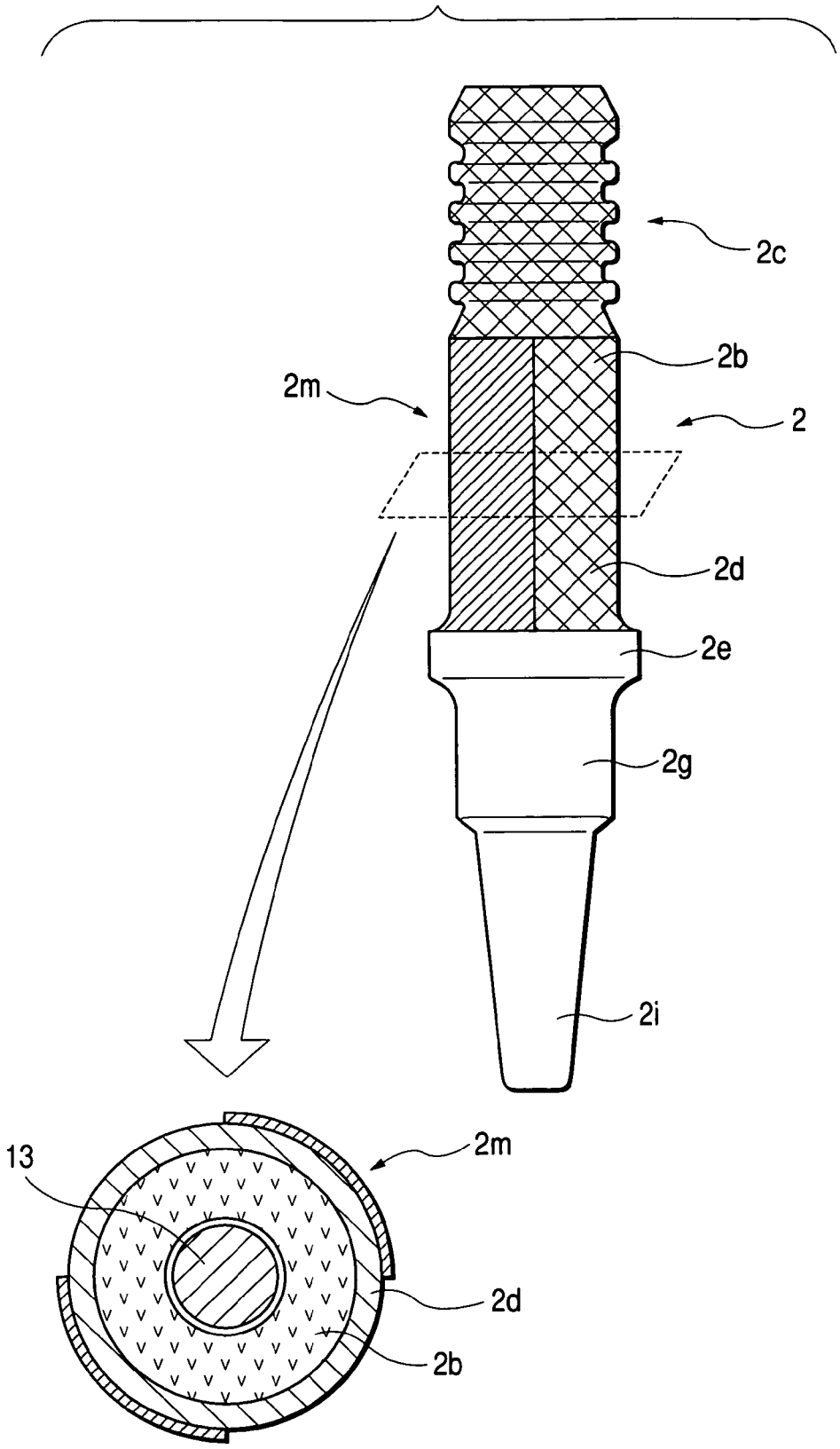

Using the foregoing ink and glaze slurry, the marking layer and the glaze layer were formed in the mode of overglaze where the marking layer was formed on the surface of the glaze layer as shown in FIG. 2. The formation method is as follows. First of all, the glaze slurry was sprayed on the surface of the insulator from a spray nozzle in the foregoing method, followed by drying to form the coated layer of the glaze slurry. Incidentally, the coating thickness of the coated layer of the glaze slurry after drying was about 100 μm. And a prescribed pattern constituting the marking layer was printed and formed in a coating thickness of 2 μm on the surface of the coated layer of the glaze slurry using the foregoing ink and then dried to form a printing layer. Several kinds of the spark plug 100 shown in FIG. 1 were prepared using the insulator having the coated layer of the glaze slurry and the printing layer formed thereon. However, the outer diameter of the thread 7 was 14 mm. Also, a $B_2O_3$—$SiO_2$—BaO—$Li_2O$ based glass, a $ZrO_2$ powder, a carbon black powder, a $TiO_2$ powder, and a metallic Al powder were used as raw material powders of the resistor 15; and a $B_2O_3$—$SiO_2$—$Na_2O$ based glass, a Cu powder, an Fe powder, and an Fe—B powder were used as raw material powders of the conductive glass seal layers 16, 17. The formation was carried out at a heating temperature during glass sealing of from 800 to 1,200° C. Also, by simultaneously baking the coated layer of the glaze slurry and the printing layer during glass sealing at a heating temperature of from 800 to 1,200° C., the glaze layer and the marking layer were baked and formed. Incidentally, as shown in FIG. 7, the glaze layer and the marking layer were formed such that the surfaces of the marking layer **2*m* and the glaze layer 2*d* were alternately exposed above the main body portion 2*b* of the insulator 2** at intervals of 90° against the peripheral direction.

Several kinds of the spark plug (see FIG. 1) were prepared corresponding to the marking layer formed using each of the inks having the formulations and amounts of No. 1 to No. 46 in Table 1. These spark plugs are corresponding to No. 1 to No. 46 in Table 1, respectively.

However, with respect to No. 1 to No. 3 and No. 5 in Table 1, the marking layer could not be baked and formed. In these marking layers, the components compounded in the ink could not sufficiently react with each other so that excessive unevenness in baking occurred, or melting of only specific components among the compounds compounded in the ink was accelerated so that excessive melting sag occurred. Namely, in No. 1 to No. 3 and No. 5 in Table 1, the formation itself of the marking layer was difficult.

With respect to the park plugs of No. 4 and No. 6 to No. 46 except for No. 1 to No. 3 and No. 5, the color of the appearance of the marking layer to be viewed was visually judged, and the formulation and amount to be contained in the marking layer were measured by EPMA analysis (Electron Probe Micro Analyzer produced by JEOL, Ltd. (Model: JXA-8800M) was used. Accelerating voltage was 20 kV, Beam current was $2.5\times10^{-8}$ mA, and spot size was 1 μm or smaller). The results obtained are shown in Table 1 (the formulations being expressed in terms of oxides). Incidentally, the respective formulations and amounts corresponding to No. 1 to No. 3 and No. 5 in Table 1 express the respective formulations and amounts as expected for containing the marking layer in compounding the corresponding ink.

TABLE 1

| | | No. | | | | | |
|---|---|---|---|---|---|---|---|
| | | 1 | 2 | 3 | 4 | 5 | 6 |
| | | Color | | | | | |
| (% by mole) | | Green | Yellowish green | Blue | Blue | Yellow | Yellow |
| Si component | $SiO_2$ | 43.2 | 37.4 | 42.8 | 26.9 | 73.6 | 41.0 |
| Al component | $Al_2O_3$ | 1.3 | 1.8 | 7.4 | 17.0 | 1.8 | 0.05 |
| Alkali | $Li_2O$ | 0.0 | 0.0 | 0.0 | 0.0 | 0.0 | 0.0 |
| metal | $Na_2O$ | 3.1 | 1.5 | 2.8 | 2.8 | 1.7 | 0.0 |
| component | $K_2O$ | 0.0 | 0.0 | 0.0 | 1.4 | 1.2 | 0.9 |
| B component | $B_2O_3$ | 18.1 | 14.3 | 16.4 | 12.7 | 21.0 | 21.3 |
| First alkaline earth | MgO | 0.0 | 0.0 | 0.0 | 0.5 | 0.0 | 0.0 |
| metal component | CaO | 0.0 | 0.0 | 0.0 | 0.7 | 0.4 | 0.6 |

TABLE 1-continued

| | | | | | | | |
|---|---|---|---|---|---|---|---|
| Zn component | ZnO | 0.0 | 0.0 | 0.0 | 10.0 | 0.0 | 0.0 |
| Color development | $ZrO_2$ | 0.0 | 0.0 | 0.0 | 0.0 | 0.0 | 33.7 |
| accelerating | $TiO_2$ | 12.4 | 18.5 | 9.0 | 2.2 | 0.0 | 0.0 |
| component | | | | | | | |
| Second alkaline | SrO | 0.0 | 0.0 | 0.0 | 0.0 | 0.0 | 0.0 |
| earth | | | | | | | |
| metal component | BaO | 0.0 | 0.0 | 0.0 | 0.0 | 0.0 | 0.0 |
| Color developing | CdO | 0.0 | 7.7 | 3.7 | 0.0 | 0.3 | 0.0 |
| component | $Cr_2O_3$ | 2.1 | 0.5 | 0.0 | 0.0 | 0.0 | 0.0 |
| | CoO | 0.0 | 0.0 | 0.0 | 25.8 | 0.0 | 0.0 |
| | $SnO_2$ | 0.0 | 0.0 | 0.0 | 0.0 | 0.0 | 0.0 |
| | $Fe_2O_3$ | 0.0 | 0.0 | 0.0 | 0.0 | 0.0 | 0.0 |
| | NiO | 0.0 | 0.0 | 0.0 | 0.0 | 0.0 | 0.0 |
| | CuO | 0.0 | 0.0 | 0.0 | 0.0 | 0.0 | 0.0 |
| | $Au_2O_3$ | 0.0 | 0.0 | 0.0 | 0.0 | 0.0 | 2.4 |
| | $Pr_2O_3$ | 0.0 | 0.0 | 0.0 | 0.0 | 0.0 | 0.0 |
| | $Nd_2O_3$ | 0.0 | 0.0 | 0.0 | 0.0 | 0.0 | 0.0 |
| | $SeO_2$ | 0.0 | 0.0 | 0.0 | 0.0 | 0.0 | 0.0 |
| | $MnO_2$ | 0.0 | 0.0 | 0.0 | 0.0 | 0.0 | 0.0 |
| | $V_2O_5$ | 0.0 | 0.0 | 0.0 | 0.0 | 0.0 | 0.0 |
| | $Sb_2O_3$ | 0.0 | 0.0 | 0.0 | 0.0 | 0.0 | 0.0 |
| | $SO_3$ | 0.0 | 0.0 | 0.0 | 0.0 | 0.0 | 0.0 |
| | $La_2O_3$ | 0.0 | 0.0 | 0.0 | 0.0 | 0.0 | 0.0 |
| Pb component | PbO | 19.8 | 18.3 | 17.9 | 0.0 | 0.0 | 0.05 |
| Total | | 100.0 | 100.0 | 100.0 | 100.0 | 100.0 | 100.0 |
| Color developability | | — | — | — | ○○ | — | ○○ |
| Baking | | x | x | x | ○ | x | ○ |
| Surface smoothness | | — | — | — | ○○ | — | x |
| Insulation | | — | — | — | x | — | ○○ |
| Strength | | — | — | — | ○ | — | x |

| | | No. | | | | | |
|---|---|---|---|---|---|---|---|
| | | 7 | 8 | 9 | 10 | 11 | 12 |
| | | Color | | | | | |
| (% by mole) | | Blue | Yellow | Red | Black | Yellow | Orange |
| Si component | $SiO_2$ | 36.4 | 40.6 | 46.6 | 39.3 | 49.2 | 51.1 |
| Al component | $Al_2O_3$ | 20.4 | 0.7 | 3.4 | 1.7 | 5.7 | 5.5 |
| Alkali | $Li_2O$ | 0.0 | 0.0 | 0.0 | 0.0 | 0.0 | 0.0 |
| metal | $Na_2O$ | 1.5 | 0.0 | 4.6 | 1.3 | 0.0 | 2.5 |
| component | $K_2O$ | 0.9 | 0.05 | 5.2 | 1.0 | 2.9 | 2.6 |
| B component | $B_2O_3$ | 10.7 | 16.6 | 21.8 | 1.7 | 41.6 | 14.7 |
| First alkaline earth | MgO | 0.6 | 0.2 | 1.2 | 0.6 | 0.0 | 6.5 |
| metal component | CaO | 0.5 | 0.3 | 6.5 | 3.9 | 0.0 | 13.6 |
| Zn component | ZnO | 8.2 | 0.0 | 0.0 | 0.0 | 0.0 | 3.0 |
| Color development | $ZrO_2$ | 0.0 | 39.8 | 9.8 | 10.6 | 0.0 | 0.4 |
| accelerating | $TiO_2$ | 0.0 | 0.0 | 0.0 | 0.0 | 0.0 | 0.0 |
| component | | | | | | | |
| Second alkaline | SrO | 0.0 | 0.0 | 0.0 | 0.0 | 0.0 | 0.0 |
| earth | | | | | | | |
| metal component | BaO | 0.0 | 0.0 | 0.0 | 0.0 | 0.0 | 0.0 |
| Color developing | CdO | 0.0 | 0.0 | 0.3 | 0.0 | 0.7 | 0.1 |
| component | $Cr_2O_3$ | 0.0 | 0.0 | 0.0 | 4.8 | 0.0 | 0.0 |
| | CoO | 20.8 | 0.0 | 0.4 | 16.5 | 0.0 | 0.0 |
| | $SnO_2$ | 0.0 | 0.0 | 0.0 | 0.0 | 0.0 | 0.0 |
| | $Fe_2O_3$ | 0.0 | 0.0 | 0.2 | 6.0 | 0.0 | 0.0 |
| | NiO | 0.0 | 0.0 | 0.0 | 12.6 | 0.0 | 0.0 |
| | CuO | 0.0 | 0.0 | 0.0 | 0.0 | 0.0 | 0.0 |
| | $Au_2O_3$ | 0.0 | 1.8 | 0.0 | 0.0 | 0.0 | 0.0 |
| | $Pr_2O_3$ | 0.0 | 0.0 | 0.0 | 0.0 | 0.0 | 0.0 |
| | $Nd_2O_3$ | 0.0 | 0.0 | 0.0 | 0.0 | 0.0 | 0.0 |
| | $SeO_2$ | 0.0 | 0.0 | 0.0 | 0.0 | 0.0 | 0.0 |
| | $MnO_2$ | 0.0 | 0.0 | 0.0 | 0.0 | 0.0 | 0.0 |
| | $V_2O_5$ | 0.0 | 0.0 | 0.0 | 0.0 | 0.0 | 0.0 |
| | $Sb_2O_3$ | 0.0 | 0.0 | 0.0 | 0.0 | 0.0 | 0.0 |
| | $SO_3$ | 0.0 | 0.0 | 0.0 | 0.0 | 0.0 | 0.0 |
| | $La_2O_3$ | 0.0 | 0.0 | 0.0 | 0.0 | 0.0 | 0.0 |
| Pb component | PbO | 0.0 | 0.0 | 0.0 | 0.0 | 0.0 | 0.0 |
| Total | | 100.0 | 100.0 | 100.0 | 100.0 | 100.0 | 100.0 |
| Color developability | | x | ○○ | ○○ | ○○ | x | ○○ |
| Baking | | ○ | ○ | ○ | ○ | ○ | Δ |
| Surface smoothness | | ○○ | x | ○ | x | ○ | ○○ |
| Insulation | | ○○ | ○○ | x | ○○ | ○ | ○ |
| Strength | | ○ | ○ | ○ | ○ | ○ | ○ |

TABLE 1-continued

| | | No. | | | | | |
|---|---|---|---|---|---|---|---|
| | | 13 | 14 | 15 | 16 | 17 | 18 |
| | | Color | | | | | |
| (% by mole) | | Pale blue | Yellow | Orange | Pale blue | Green | Red |
| Si component | $SiO_2$ | 40.5 | 36.9 | 49.8 | 43.3 | 57.0 | 59.5 |
| Al component | $Al_2O_3$ | 8.4 | 0.9 | 4.4 | 6.8 | 2.0 | 5.0 |
| Alkali | $Li_2O$ | 0.0 | 0.0 | 0.0 | 3.3 | 0.0 | 0.0 |
| metal | $Na_2O$ | 3.1 | 0.0 | 1.6 | 0.0 | 4.3 | 2.5 |
| component | $K_2O$ | 1.3 | 0.3 | 1.5 | 0.0 | 0.0 | 2.0 |
| B component | $B_2O_3$ | 14.1 | 12.8 | 20.4 | 22.8 | 16.8 | 12.9 |
| First alkaline earth | MgO | 0.8 | 0.3 | 1.7 | 2.9 | 0.0 | 1.4 |
| metal component | CaO | 2.3 | 0.6 | 6.0 | 0.0 | 0.0 | 5.9 |
| Zn component | ZnO | 15.8 | 0.0 | 3.3 | 7.9 | 0.0 | 0.0 |
| Color development | $ZrO_2$ | 9.7 | 46.6 | 8.9 | 10.1 | 0.0 | 7.6 |
| accelerating | $TiO_2$ | 0.0 | 0.0 | 0.0 | 0.0 | 16.9 | 0.0 |
| component | | | | | | | |
| Second alkaline | SrO | 0.0 | 0.0 | 0.0 | 0.0 | 0.0 | 0.0 |
| earth | BaO | 0.0 | 0.0 | 2.3 | 0.0 | 0.0 | 0.0 |
| metal component | | | | | | | |
| Color developing | CdO | 0.0 | 0.0 | 0.1 | 0.0 | 0.0 | 0.0 |
| component | $Cr_2O_3$ | 0.0 | 0.0 | 0.0 | 0.0 | 3.0 | 0.0 |
| | CoO | 4.0 | 0.0 | 0.0 | 3.1 | 0.0 | 0.0 |
| | $SnO_2$ | 0.0 | 0.0 | 0.0 | 0.0 | 0.0 | 0.0 |
| | $Fe_2O_3$ | 0.0 | 0.0 | 0.0 | 0.0 | 0.0 | 0.0 |
| | NiO | 0.0 | 0.0 | 0.0 | 0.0 | 0.0 | 0.0 |
| | CuO | 0.0 | 0.0 | 0.0 | 0.0 | 0.0 | 0.0 |
| | $Au_2O_3$ | 0.0 | 0.0 | 0.0 | 0.0 | 0.0 | 0.0 |
| | $Pr_2O_3$ | 0.0 | 1.6 | 0.0 | 0.0 | 0.0 | 0.0 |
| | $Nd_2O_3$ | 0.0 | 0.0 | 0.0 | 0.0 | 0.0 | 0.0 |
| | $SeO_2$ | 0.0 | 0.0 | 0.0 | 0.0 | 0.0 | 0.0 |
| | $MnO_2$ | 0.0 | 0.0 | 0.0 | 0.0 | 0.0 | 1.4 |
| | $V_2O_5$ | 0.0 | 0.0 | 0.0 | 0.0 | 0.0 | 0.0 |
| | $Sb_2O_3$ | 0.0 | 0.0 | 0.0 | 0.0 | 0.0 | 0.0 |
| | $SO_3$ | 0.0 | 0.0 | 0.0 | 0.0 | 0.0 | 0.0 |
| | $La_2O_3$ | 0.0 | 0.0 | 0.0 | 0.0 | 0.0 | 0.0 |
| Pb component | PbO | 0.0 | 0.0 | 0.0 | 0.0 | 0.0 | 1.8 |
| Total | | 100.0 | 100.0 | 100.0 | 100.0 | 100.0 | 100.0 |
| Color devolopability | | Δ | Δ | ○○ | ○○ | ○○ | ○○ |
| Baking | | ○ | ○ | ○ | ○ | ○ | ○ |
| Surface smoothness | | ○ | ○ | ○○ | ○○ | ○ | ○ |
| Insulation | | ○○ | ○○ | ○○ | ○○ | ○ | ○○ |
| Strength | | ○ | ○ | Δ | ○ | ○ | ○ |

| | | No. | | | | | |
|---|---|---|---|---|---|---|---|
| | | 19 | 20 | 21 | 22 | 23 | 24 |
| | | Color | | | | | |
| (% by mole) | | Blue | Gray | Black | Yellow | Red | Red |
| Si component | $SiO_2$ | 43.9 | 60.8 | 36.5 | 43.6 | 71.8 | 55.3 |
| Al component | $Al_2O_3$ | 10.1 | 7.5 | 1.6 | 0.3 | 3.2 | 3.4 |
| Alkali | $Li_2O$ | 0.0 | 0.0 | 0.0 | 0.0 | 0.0 | 0.0 |
| metal | $Na_2O$ | 1.6 | 3.7 | 1.3 | 0.0 | 2.2 | 3.0 |
| component | $K_2O$ | 1.3 | 4.3 | 1.0 | 0.3 | 2.2 | 1.7 |
| B component | $B_2O_3$ | 15.7 | 20.6 | 3.5 | 12.7 | 19.1 | 17.1 |
| First alkaline earth | MgO | 0.4 | 0.0 | 0.6 | 0.0 | 0.0 | 0.9 |
| metal component | CaO | 0.6 | 0.5 | 3.9 | 1.0 | 0.1 | 6.1 |
| Zn component | ZnO | 6.9 | 0.0 | 0.0 | 0.0 | 0.0 | 0.0 |
| Color development | $ZrO_2$ | 17.8 | 0.0 | 10.4 | 40.4 | 0.0 | 11.3 |
| accelerating | $TiO_2$ | 0.0 | 0.0 | 0.0 | 0.0 | 0.0 | 0.0 |
| component | | | | | | | |
| Second alkaline | SrO | 0.0 | 0.0 | 0.0 | 0.0 | 0.0 | 0.0 |
| earth | | | | | | | |
| metal component | BaO | 0.0 | 0.0 | 0.0 | 0.0 | 0.0 | 0.0 |
| Color developing | CdO | 0.0 | 0.0 | 0.0 | 0.0 | 0.0 | 0.1 |
| component | $Cr_2O_3$ | 0.0 | 0.0 | 5.1 | 0.0 | 0.0 | 0.0 |
| | CoO | 0.0 | 0.0 | 16.8 | 0.0 | 0.0 | 0.0 |
| | $SnO_2$ | 0.0 | 2.0 | 0.0 | 0.0 | 1.38 | 0.0 |
| | $Fe_2O_3$ | 0.0 | 0.0 | 5.9 | 0.0 | 0.0 | 0.0 |
| | NiO | 0.0 | 0.0 | 13.4 | 0.0 | 0.0 | 0.0 |
| | CuO | 0.0 | 0.0 | 0.0 | 0.0 | 0.0 | 0.0 |
| | $Au_2O_3$ | 0.0 | 0.0 | 0.0 | 0.0 | 0.02 | 0.0 |
| | $Pr_2O_3$ | 0.0 | 0.0 | 0.0 | 1.7 | 0.0 | 0.0 |

TABLE 1-continued

| | | | | | | | |
|---|---|---|---|---|---|---|---|
| | $Nd_2O_3$ | 0.0 | 0.0 | 0.0 | 0.0 | 0.0 | 0.0 |
| | $SeO_2$ | 0.0 | 0.0 | 0.0 | 0.0 | 0.0 | 0.0 |
| | $MnO_2$ | 0.0 | 0.0 | 0.0 | 0.0 | 0.0 | 0.0 |
| | $V_2O_5$ | 1.7 | 0.0 | 0.0 | 0.0 | 0.0 | 0.0 |
| | $Sb_2O_3$ | 0.0 | 0.0 | 0.0 | 0.0 | 0.0 | 0.0 |
| | $SO_3$ | 0.0 | 0.0 | 0.0 | 0.0 | 0.0 | 0.0 |
| | $La_2O_3$ | 0.0 | 0.0 | 0.0 | 0.0 | 0.0 | 0.0 |
| Pb component | PbO | 0.0 | 0.0 | 0.0 | 0.0 | 0.0 | 1.1 |
| Total | | 100.0 | 100.0 | 100.0 | 100.0 | 100.0 | 100.0 |
| Color developability | | ○○ | ○ | ○○ | ○○ | ○ | ○○ |
| Baking | | ○ | ○ | ○ | ○ | ○ | ○ |
| Surface smoothness | | ○○ | ○ | ○ | ○ | ○ | ○ |
| Insulation | | ○○ | ○○ | ○○ | ○○ | ○○ | ○○ |
| Strength | | ○ | ○ | ○ | ○ | ○ | ○ |

| | | No. | | | | | |
|---|---|---|---|---|---|---|---|
| | | 25 | 26 | 27 | 28 | 29 | 30 |
| | | Color | | | | | |
| (% by mole) | | Red | Yellow | Yellow | Orange | Orange | Orange |
| Si component | $SiO_2$ | 54.7 | 50.5 | 52.6 | 52.1 | 51.8 | 45.3 |
| Al component | $Al_2O_3$ | 3.0 | 4.3 | 5.0 | 4.5 | 5.6 | 5.5 |
| Alkali | $Li_2O$ | 0.0 | 0.0 | 0.0 | 0.0 | 0.0 | 0.0 |
| metal | $Na_2O$ | 2.2 | 0.0 | 0.0 | 2.7 | 1.5 | 1.7 |
| component | $K_2O$ | 1.8 | 2.0 | 2.5 | 2.0 | 2.5 | 2.6 |
| B component | $B_2O_3$ | 21.0 | 18.3 | 17.3 | 20.4 | 19.3 | 17.2 |
| First alkaline earth | MgO | 1.1 | 0.9 | 2.2 | 0.0 | 1.5 | 1.2 |
| metal component | CaO | 5.4 | 7.0 | 5.6 | 7.7 | 6.7 | 2.2 |
| Zn component | ZnO | 0.0 | 3.2 | 2.8 | 1.3 | 3.6 | 0.6 |
| Color development | $ZrO_2$ | 9.2 | 11.8 | 11.0 | 9.2 | 6.1 | 0.0 |
| accelerating | $TiO_2$ | 0.0 | 0.0 | 0.0 | 0.0 | 0.0 | 23.6 |
| component | | | | | | | |
| Second alkaline | SrO | 0.0 | 0.0 | 0.0 | 0.0 | 0.0 | 0.0 |
| earth | | | | | | | |
| metal component | BaO | 0.0 | 0.7 | 0.9 | 0.0 | 1.3 | 0.0 |
| Color developing | CdO | 0.05 | 1.2 | 0.1 | 0.1 | 0.1 | 0.1 |
| component | $Cr_2O_3$ | 0.0 | 0.0 | 0.0 | 0.0 | 0.0 | 0.0 |
| | CoO | 0.0 | 0.0 | 0.0 | 0.0 | 0.0 | 0.0 |
| | $SnO_2$ | 0.0 | 0.0 | 0.0 | 0.0 | 0.0 | 0.0 |
| | $Fe_2O_3$ | 0.0 | 0.0 | 0.0 | 0.0 | 0.0 | 0.0 |
| | NiO | 0.0 | 0.0 | 0.0 | 0.0 | 0.0 | 0.0 |
| | CuO | 0.0 | 0.0 | 0.0 | 0.0 | 0.0 | 0.0 |
| | $Au_2O_3$ | 0.0 | 0.0 | 0.0 | 0.0 | 0.0 | 0.0 |
| | $Pr_2O_3$ | 0.0 | 0.0 | 0.0 | 0.0 | 0.0 | 0.0 |
| | $Nd_2O_3$ | 0.0 | 0.0 | 0.0 | 0.0 | 0.0 | 0.0 |
| | $SeO_2$ | 0.05 | 0.0 | 0.0 | 0.0 | 0.0 | 0.0 |
| | $MnO_2$ | 0.0 | 0.0 | 0.0 | 0.0 | 0.0 | 0.0 |
| | $V_2O_5$ | 0.0 | 0.0 | 0.0 | 0.0 | 0.0 | 0.0 |
| | $Sb_2O_3$ | 0.0 | 0.0 | 0.0 | 0.0 | 0.0 | 0.0 |
| | $SO_3$ | 0.0 | 0.0 | 0.0 | 0.0 | 0.0 | 0.0 |
| | $La_2O_3$ | 0.0 | 0.0 | 0.0 | 0.0 | 0.0 | 0.0 |
| Pb component | PbO | 1.5 | 0.1 | 0.0 | 0.0 | 0.0 | 0.0 |
| Total | | 100.0 | 100.0 | 100.0 | 100.0 | 100.0 | 100.0 |
| Color developability | | ○○ | ○○ | ○○ | ○○ | ○○ | ○○ |
| Baking | | ○ | ○ | ○ | ○ | ○ | ○ |
| Surface smoothness | | ○ | ○○ | ○○ | ○○ | ○○ | ○○ |
| Insulation | | ○○ | ○○ | ○○ | ○○ | ○○ | ○○ |
| Strength | | ○ | ○○ | ○○ | ○ | ○○ | ○ |

| | | No. | | | | | |
|---|---|---|---|---|---|---|---|
| | | 31 | 32 | 33 | 34 | 35 | 36 |
| | | Color | | | | | |
| (% by mole) | | Red | Red | Yellow | Yellowish green | Green | Blue |
| Si component | $SiO_2$ | 53.0 | 50.7 | 50.8 | 47.5 | 43.0 | 36.9 |
| Al component | $Al_2O_3$ | 4.0 | 3.6 | 6.8 | 2.4 | 4.2 | 16.3 |
| Alkali | $Li_2O$ | 0.0 | 0.0 | 0.0 | 0.0 | 0.0 | 0.0 |
| metal | $Na_2O$ | 4.1 | 3.6 | 4.4 | 2.3 | 2.6 | 1.9 |
| component | $K_2O$ | 2.2 | 1.8 | 2.2 | 1.6 | 1.6 | 1.0 |
| B component | $B_2O_3$ | 16.7 | 15.1 | 13.7 | 17.7 | 17.3 | 13.7 |
| First alkaline earth | MgO | 1.0 | 1.6 | 0.8 | 0.5 | 0.3 | 0.3 |
| metal component | CaO | 9.7 | 14.8 | 7.7 | 3.9 | 6.5 | 0.4 |

TABLE 1-continued

| | | | | | | | |
|---|---|---|---|---|---|---|---|
| Zn component | ZnO | 0.0 | 0.0 | 0.0 | 0.0 | 3.9 | 8.9 |
| Color development accelerating component | $ZrO_2$ | 8.4 | 7.8 | 13.1 | 20.0 | 9.2 | 0.4 |
| | $TiO_2$ | 0.0 | 0.0 | 0.0 | 0.0 | 0.0 | 0.0 |
| Second alkaline earth metal component | SrO | 0.0 | 0.0 | 0.0 | 0.0 | 0.0 | 0.0 |
| | BaO | 0.0 | 0.0 | 0.0 | 0.0 | 0.0 | 0.0 |
| Color developing component | CdO | 0.2 | 0.2 | 0.5 | 0.0 | 0.0 | 0.0 |
| | $Cr_2O_3$ | 0.0 | 0.0 | 0.0 | 3.4 | 6.3 | 0.0 |
| | CoO | 0.5 | 0.6 | 0.0 | 0.0 | 4.9 | 20.2 |
| | $SnO_2$ | 0.0 | 0.0 | 0.0 | 0.0 | 0.0 | 0.0 |
| | $Fe_2O_3$ | 0.2 | 0.2 | 0.0 | 0.0 | 0.0 | 0.0 |
| | NiO | 0.0 | 0.0 | 0.0 | 0.0 | 0.0 | 0.0 |
| | CuO | 0.0 | 0.0 | 0.0 | 0.0 | 0.0 | 0.0 |
| | $Au_2O_3$ | 0.0 | 0.0 | 0.0 | 0.0 | 0.0 | 0.0 |
| | $Pr_2O_3$ | 0.0 | 0.0 | 0.0 | 0.7 | 0.2 | 0.0 |
| | $Nd_2O_3$ | 0.0 | 0.0 | 0.0 | 0.0 | 0.0 | 0.0 |
| | $SeO_2$ | 0.0 | 0.0 | 0.0 | 0.0 | 0.0 | 0.0 |
| | $MnO_2$ | 0.0 | 0.0 | 0.0 | 0.0 | 0.0 | 0.0 |
| | $V_2O_5$ | 0.0 | 0.0 | 0.0 | 0.0 | 0.0 | 0.0 |
| | $Sb_2O_3$ | 0.0 | 0.0 | 0.0 | 0.0 | 0.0 | 0.0 |
| | $SO_3$ | 0.0 | 0.0 | 0.0 | 0.0 | 0.0 | 0.0 |
| | $La_2O_3$ | 0.0 | 0.0 | 0.0 | 0.0 | 0.0 | 0.0 |
| Pb component | PbO | 0.0 | 0.0 | 0.0 | 0.0 | 0.0 | 0.0 |
| Total | | 100.0 | 100.0 | 100.0 | 100.0 | 100.0 | 100.0 |
| Color developability | | ○○ | ○○ | ○○ | ○○ | ○○ | ○○ |
| Baking | | ○ | ○ | ○ | ○ | ○ | ○ |
| Surface smoothness | | ○ | ○ | ○ | ○ | ○○ | ○○ |
| Insulation | | ○○ | ○○ | ○○ | ○○ | ○○ | ○○ |
| Strength | | ○ | ○ | ○ | ○ | ○ | ○ |

| | | No. | | | | | |
|---|---|---|---|---|---|---|---|
| | | 37 | 38 | 39 | 40 | 41 | 42 |
| | | Color | | | | | |
| (% by mole) | | Pale blue | Violet | Yellow | Yellow | Yellow | Yellow |
| Si component | $SiO_2$ | 42.0 | 57.4 | 59.1 | 60.2 | 63.4 | 43.8 |
| Al component | $Al_2O_3$ | 8.5 | 6.0 | 6.8 | 6.4 | 6.9 | 0.6 |
| Alkali metal component | $Li_2O$ | 0.0 | 0.0 | 0.0 | 0.0 | 0.0 | 0.0 |
| | $Na_2O$ | 4.1 | 2.6 | 0.0 | 0.0 | 0.0 | 0.0 |
| | $K_2O$ | 1.6 | 2.4 | 3.4 | 2.9 | 3.1 | 0.3 |
| B component | $B_2O_3$ | 16.5 | 22.7 | 29.9 | 24.2 | 23.8 | 16.3 |
| First alkaline earth metal component | MgO | 0.7 | 0.0 | 0.0 | 0.0 | 0.0 | 0.0 |
| | CaO | 2.6 | 0.4 | 0.0 | 0.0 | 0.0 | 1.3 |
| Zn component | ZnO | 9.9 | 0.0 | 0.0 | 5.5 | 0.0 | 0.0 |
| Color development accelerating component | $ZrO_2$ | 10.4 | 0.0 | 0.0 | 0.0 | 0.0 | 35.3 |
| | $TiO_2$ | 0.0 | 0.0 | 0.0 | 0.0 | 0.0 | 0.0 |
| Second alkaline earth metal component | SrO | 0.0 | 0.0 | 0.0 | 0.0 | 0.4 | 0.0 |
| | BaO | 0.0 | 0.0 | 0.0 | 0.0 | 1.4 | 0.0 |
| Color developing component | CdO | 0.0 | 0.0 | 0.8 | 0.8 | 1.0 | 0.0 |
| | $Cr_2O_3$ | 0.0 | 0.0 | 0.0 | 0.0 | 0.0 | 0.0 |
| | CoO | 3.7 | 7.5 | 0.0 | 0.0 | 0.0 | 0.0 |
| | $SnO_2$ | 0.0 | 1.0 | 0.0 | 0.0 | 0.0 | 0.0 |
| | $Fe_2O_3$ | 0 | 0.0 | 0.0 | 0.0 | 0.0 | 0.0 |
| | NiO | 0.0 | 0.0 | 0.0 | 0.0 | 0.0 | 0.0 |
| | CuO | 0.0 | 0.0 | 0.0 | 0.0 | 0.0 | 0.0 |
| | $Au_2O_3$ | 0.0 | 0.0 | 0.0 | 0.0 | 0.0 | 0.0 |
| | $Pr_2O_3$ | 0.0 | 0.0 | 0.0 | 0.0 | 0.0 | 1.9 |
| | $Nd_2O_3$ | 0.0 | 0.0 | 0.0 | 0.0 | 0.0 | 0.5 |
| | $SeO_2$ | 0.0 | 0.0 | 0.0 | 0.0 | 0.0 | 0.0 |
| | $MnO_2$ | 0.0 | 0.0 | 0.0 | 0.0 | 0.0 | 0.0 |
| | $V_2O_5$ | 0.0 | 0.0 | 0.0 | 0.0 | 0.0 | 0.0 |
| | $Sb_2O_3$ | 0.0 | 0.0 | 0.0 | 0.0 | 0.0 | 0.0 |
| | $SO_3$ | 0.0 | 0.0 | 0.0 | 0.0 | 0.0 | 0.0 |
| | $La_2O_3$ | 0.0 | 0.0 | 0.0 | 0.0 | 0.0 | 0.0 |
| Pb component | PbO | 0.0 | 0.0 | 0.0 | 0.0 | 0.0 | 0.0 |
| Total | | 100.0 | 100.0 | 100.0 | 100.0 | 100.0 | 100.0 |
| Color developability | | ○○ | ○ | ○ | ○ | ○ | ○○ |
| Baking | | ○ | ○ | ○ | ○ | ○ | ○ |
| Surface smoothness | | ○○ | ○ | ○ | ○○ | ○ | ○ |
| Insulation | | ○○ | ○○ | ○ | ○ | ○ | ○○ |
| Strength | | ○ | ○ | ○ | ○ | ○○ | ○ |

TABLE 1-continued

| | | No. | | | |
|---|---|---|---|---|---|
| | | 43 | 44 | 45 | 46 |
| | | Color | | | |
| (% by mole) | | Black | Black | Black | Black |
| Si component | $SiO_2$ | 36.2 | 40.9 | 51.4 | 52.7 |
| Al component | $Al_2O_3$ | 1.4 | 5.2 | 4.2 | 4.5 |
| Alkali | $Li_2O$ | 0.0 | 0.0 | 0.0 | 0.0 |
| metal | $Na_2O$ | 1.3 | 9.7 | 2.1 | 2.4 |
| component | $K_2O$ | 1.2 | 2.7 | 2.0 | 2.4 |
| B component | $B_2O_3$ | 3.9 | 15.0 | 14.5 | 16.2 |
| First alkaline earth | MgO | 0.5 | 0.0 | 0.8 | 0.8 |
| metal component | CaO | 3.7 | 0.6 | 0.6 | 0.9 |
| Zn component | ZnO | 0.0 | 0.6 | 0.9 | 1.0 |
| Color development | $ZrO_2$ | 8.8 | 0.0 | 0.8 | 0.9 |
| accelerating component | $TiO_2$ | 0.0 | 0.0 | 0.0 | 0.0 |
| Second alkaline earth | SrO | 0.0 | 0.0 | 0.0 | 0.0 |
| metal component | BaO | 0.0 | 0.1 | 0.5 | 0.6 |
| Color developing | CdO | 0.0 | 0.0 | 0.0 | 0.0 |
| component | $Cr_2O_3$ | 5.9 | 2.2 | 1.9 | 1.4 |
| | CoO | 16.3 | 13.3 | 11.7 | 8.5 |
| | $SnO_2$ | 0.0 | 0.0 | 0.0 | 0.0 |
| | $Fe_2O_3$ | 6.2 | 2.1 | 1.9 | 1.8 |
| | NiO | 14.1 | 7.7 | 6.8 | 0.0 |
| | CuO | 0.5 | 0.0 | 0.0 | 0.0 |
| | $Au_2O_3$ | 0.0 | 0.0 | 0.0 | 0.0 |
| | $Pr_2O_3$ | 0.0 | 0.0 | 0.0 | 0.0 |
| | $Nd_2O_3$ | 0.0 | 0.0 | 0.0 | 0.0 |
| | $SeO_2$ | 0.0 | 0.0 | 0.0 | 0.0 |
| | $MnO_2$ | 0.0 | 0.0 | 0.0 | 5.7 |
| | $V_2O_5$ | 0.0 | 0.0 | 0.0 | 0.0 |
| | $Sb_2O_3$ | 0.0 | 0.0 | 0.0 | 0.0 |
| | $SO_3$ | 0.0 | 0.1 | 0.0 | 0.0 |
| | $La_2O_3$ | 0.0 | 0.0 | 0.1 | 0.1 |
| Pb component | PbO | 0.0 | 0.0 | 0.0 | 0.0 |
| Total | | 100.0 | 100.0 | 100.0 | 100.0 |
| Color developability | | ○○ | ○ | ○○ | ○○ |
| Baking | | ○ | ○ | ○ | ○ |
| Surface smoothness | | ○ | ○○ | ○○ | ○○ |
| Insulation | | ○○ | ○○ | ○○ | ○○ |
| Strength | | ○ | ○○ | ○○ | ○○ |

It is understood from Table 1 that by properly choosing and adjusting the kinds and contents of the color developing components to be contained in the marking layer, it is possible to subject the marking layer to coloration in a varied color. Also, though No. 1 to No. 11 fall outside the scope of the invention, it is understood that with respect to others (No. 12 to No. 46), the content of the Pb component to be contained in the marking layer is at least not more than 5% by mole in terms of PbO.

Also, with respect to No. 4 and No. 6 to No. 41 that are considered possible for baking and forming the marking layer, the following measurements were carried out for the purposes of confirming the smoothness of the marking layer, the strength and insulation of the marking layer, and the color developability of the color developing component to be contained in the marking layer. Incidentally, with respect to No. 1 to No. 3, since the content of the Pb component to be contained in the marking layer is excessively high, it may be said that the softening point of the Si component as the glass component is excessively lowered, resulting in making the baking and formation of the marking layer difficult. From these viewpoints, the invention gives rise to an effect for making the content of the Pb component to be contained in the marking layer not more than 5% by mole in terms of PbO. on the other hand, with respect to No. 5, since the content of the Si component to be contained in the marking layer exceeds 72% by mole in terms of $SiO_2$, it may be said that fluidity of the particles in baking and forming the marking layer was retarded, whereby the marking layer could not be baked and formed in the state where the Si component sufficiently reacts. For that reason, it is necessary that the content of the Si component to be contained in the marking layer is at least not more than 72% by mole in terms of $SiO_2$.

The smoothness of the surface of the marking layer was visually judged. Also, when the appearance of the marking layer was viewed, the smoothness of the surface of the marking layer was judged depending upon whether the gloss of the surface to be viewed was good or bad. This is because if the surface involves macroscopic inconveniences such as dry spots and cutouts or microscopic inconveniences such as surface unevennesses and deficiencies, the light irradiated on the surface causes irregular reflection on the surface or is absorbed in the deficiencies, thereby retarding the gloss of the surface of the marking layer to be viewed. Then, in viewing the appearance of the marking layer, the case where the gloss of the surface was very good is designated as "○○"; the case where the gloss of the surface was good is designated as "○"; and the case where the surface was not glossy and poor in gloss is designated as "x", respectively.

Next, whether the strength of the marking layer was good or bad was judged according to a thermal shock test against the insulator. The thermal shock test is a test in which the insulator heated at a prescribed temperature is thrown into water, and the heating temperature at which breakage of the insulator begins to occur is examined. Then, with respect to the temperate at which the insulator begins to occur, the insulators having a marking layer formed thereon according to the Example were compared with those having no marking layer formed thereon according to the Comparative Example. As a result, in comparison with the temperature at which breakage of the insulator according to the Comparative Example began to occur, the case where no lowering in the temperature at which the insulator according to the Example began to occur was found is designated as "○○"; the case where the lowering in temperature was more than 0° C. but less than 5° C. is deginated as "○"; the case where the lowering in temperature was 5° C. or more but less than 10° C. is designated as "Δ"; and the case where the lowering in temperature was 10° C. or more is designated as "x", respectively. Incidentally, the insulators having no marking layer formed thereon according to the Comparative Example are those prepared under the same conditions as in the insulators according to the Example, except for the condition relative to the marking layer. That is, the spark plugs according to the Comparative Examples are those as in the spark plugs according to the Example, from which only the marking layer is eliminated. Further, the thermal shock test was carried out with respect to five samples prepared under the same conditions for both of the Example and Comparative Example, and the temperature at which breakage of the insulator began to occur is an average value of these five samples. Also, the thermal shock test was successively carried out by increasing the temperature of the insulator at an interval of 2° C. until the breakage of the insulator began to occur.

Next, whether the insulation of the marking layer was good or bad was judged by generating flashover on the surface exposed and formed on the surface of the insulator and examining a lowering in flashover voltage after one minute. Concretely, whether the insulation of the marking layer was good or bad was judged by carrying out a comparative test between the insulator according to the Example, in which the marking layer and the glaze layer are formed as shown in FIG. 7, and the insulator according to the Comparative Example, in which the marking layer is not formed. Incidentally, likewise the case as described previously, the insulators having no marking layer formed thereon according to the Comparative Example are those prepared under the same conditions as in the insulators according to the Example, except for the condition relative to the marking layer. Accordingly, the surface exposed and formed on the surface of the insulator according to the Example is the surfaces of the marking layer and the glaze layer, whereas the surface according to the Comparative Examples is only the surface of the glaze layer. Comparative experiments were carried out under these conditions. As the difference of a lowering in the flashover voltage of the Example from that of the Comparative Example is small, the insulation of the marking layer is more secured. Then, in comparison with a lowering in the flashover voltage of the Comparative Example, the case where no difference was found in the lowering in the flashover voltage of the Example is designated as "○○"; the case where a difference in the flashover voltage of the Example was more than 0 kV but less than 1 kV is designated as "○"; and a difference in the flashover voltage of the Example was 1 kV or more is designated as "x", respectively. Also, the marking layer is formed such that it occupies approximately a half of the area of the main body portion 2*b* of the insulator 2 as shown in FIG. 7. Then, for example, in the case where the area of the marking layer to be formed is smaller than this, the insulator designated as "○" is one where no difference in the lowering of the flashover voltage is found. Actually, it may be said that the insulator designated as "○" is very good at the same level as that designated as "○○". Also, this is also the same in the foregoing thermal shock test, and when the area of the marking layer to be formed is small, the insulator designated as "○" is very good at the same level as that designated as "○○".

Next, whether the color developability of the marking layer was good or bad was judged based on the degree of coloration of the marking layer to be viewed in visually observing the appearance of the marking layer. Also, the degree of coloration of the masking layer was judged according to the degree of bleeding of the color to be viewed, the degree on how the color to be viewed looks dark and dull, the degree of gloss of the color to be viewed, the degree of discoloration to exhibit what the color to be viewed does not contain a component having a color different from the desired color and the degree on how the color is viewed as the desired color, and the degree of tint of the color to be viewed. Then, in viewing the appearance of the marking layer, the case where the degree of coloration to be viewed was very good is designated as "○○"; the case where the degree of coloration to be viewed was good is designated as "○"; the case where the color to be viewed fell within the allowable range as good products but became dark and dull or caused bleeding slightly is designated as "Δ"; and the case where the color was not viewed as the desired colored and became dark and dull conspicuously is designated as "x", respectively.

With respect to the No. 4 and No. 6 to No. 46, whether the smoothness of the surface of the marking layer, the strength and insulation of the marking layer, and the color developability of the color developing component to be contained in the marking layer were each good or bad according to the foregoing manners. The results are shown in Table 1.

Also, Table 1 shows the results of the baking judgment in which under the conditions within the baking temperature range of from 800 to 1,200° C. according to the Example, the case where the marking layer could not be baked is designated as "x", and the case where the marking layer could be baked under the foregoing conditions of the baking temperature range is designated as "○", respectively.

No. 4 and No. 6 to No. 11 fall outside the scope of the invention. In No. 4, since the content of the Si component to be contained in the marking layer is less than 36% by mole in terms of $SiO_2$, the marking layer could not secure the insulation to extent such that it contributes to prevention of the flashover phenomenon. It is understood from the results of No. 4 and No. 5 as described previously that it is necessary that the content of the Si content to be contained in the marking layer is from 36% by mole to 72% by mole in terms of $SiO_2$. Next, in No. 6, since the content of the Al component to be contained in the marking layer is less than 0.1% by mole in terms of $Al_2O_3$, the strength of the marking layer, namely, the strength of the insulator having a marking layer formed thereon, cannot be sufficiently secured. Also, the smoothness on the surface of the marking layer cannot be sufficiently secured. On the other hand, in No. 7, since the content of the Al component to be contained in the marking layer is more than 18% by mole in terms of $Al_2O_3$, the color developing component to be contained in the marking layer does not sufficiently bring about its color developing effect, and the making layer cannot secure the desired color developability. From these results, it is necessary that the content of the Al component to be contained in the marking layer is from 0.1% by mole to 18% by mole in terms of $Al_2O_3$. Next, with respect to the content of the alkali metal component selected from one or two or more kinds of the Li component, the Na component and the K component in terms of $Li_2O$, $Na_2O$ and $K_2O$, respectively, in No. 8, since the subject content is less than 0.1% by mole, the smoothness on the surface of the marking layer cannot be sufficiently secured, whereas in No. 9, since the subject content is more than 9% by mole, the marking layer cannot secure the insulation to extent such that it contributes to prevention of the flashover phenomenon. From these results, it is necessary that the content of the alkali metal component to be contained in the marking layer is from 0.1% by mole to 9% by mole.

Next, with respect to the content of the B component to be contained in the marking layer in terms of $B_2O_3$, in No. 10, since the subject content is less than 3% by mole, the smoothness on the surface of the marking layer cannot be sufficiently secured, whereas in No. 11, since the subject content is more than 30% by mole, the color developing component for subjecting the marking layer to coloration cannot sufficiently bring about its coloration effect. From these results, it is necessary that the content of the B component to be contained in the marking layer is from 3% by mole to 30% by mole.

Further, it is understood from Table 1 that when the color developing component is at least contained in the marking layer, the marking layer causes coloration (for example, in No. 27, the content of the color developing component is 0.1% by mole). Also, when the marking layer is colored black, for example, as seen in No. 43, it is sufficient that the color developing component is contained in an amount of 43.2% by mole. Thus, when the content of the color developing component to be contained in the marking layer is regulated to fall within the range of more than 0% by mole but not more than 50% by mole, it is possible to subject the marking layer to coloration in a varied color such as black color inclusive of its light and shade. Incidentally, the black color as referred to herein does not mean that the light reflected from the marking layer does not contain a visible light component but means one falling within the range where a person judges it black in terms of color sense to be viewed.

In the marking layer of the invention, which contains an Si component, an Al component, an alkali metal component, and a B component as essential components in amounts falling within the foregoing ranges, not only the smoothness on the surface is secured, but also various conditions as required, such as insulation and strength, are secured even in the state where the content of the Pb component is reduced. That is, the marking layer of the invention can make the functions useful as a substitute of the glaze layer that is required in the mode of overglaze.

Also, as shown in No. 39, by containing only the foregoing essential components other than the color developing component, it is possible to make the marking layer sufficiently useful. Further, in the case of containing a Zn component in addition to the essential components, it is possible to further enhance the smoothness on the surface of the marking layer (for example, No. 40). Also, in the case of containing at least one kind of a first alkaline earth metal component of an Mg component and a Ca component, it is possible to further enhance the insulation of the marking layer (for example, No. 23). Also, in the case of containing at least one kind of a second alkaline earth metal component of an Sr component and a Ba component, it is possible to further enhance the strength of the marking layer (for example, No. 41). Also, in the case of containing at least one kind of a color developing component of a Zr component and a Ti component, it is possible to further enhance the color developability of the marking layer (for example, No. 17).

With respect to the Zn component, the first alkaline earth metal component, the second alkaline earth metal component and the color development accelerating component having the foregoing respective effects, especially by adjusting the upper limits of their contents, it is possible to make the marking layer more useful. Then, the content of the Zn component is regulated to be not more than 10% by mole in terms of ZnO. This is because when the content of the Zn component exceeds this range, the color developability of the marking layer may possibly be slightly retarded as shown in No. 13. Next, the content of the first alkaline earth metal component is regulated to be not more than 20% by mole in terms of MgO and CaO, respectively. This is because when the content of the first alkaline earth metal component exceeds this range, there are some possibilities that the softening point of the Si component to be contained in the marking layer excessively increases, that the marking layer cannot be baked in the state where the sinterability is sufficiently secured and that the baking itself is difficult. For example, in No. 12, though the baking itself was considered possible, the baking temperature was undoubtedly higher than that of others that could be baked. As a result, the sinterability was not sufficiently secured so that the appearance of the marking layer after baking became dark and dull even slightly. Next, the content of the second alkaline earth metal component is regulated to be not more than 2% by mole in terms of SrO and BaO, respectively. This is because when the content of the second alkaline earth metal component exceeds this range, the strength of the marking layer may possibly become retarded slightly. Finally, the content of the color development accelerating component is regulated to be not more than 42% by mole in terms of $ZrO_2$ and $TiO_2$, respectively. This is because when the content of the color development accelerating component exceeds this range, the color developability of the marking layer may possibly become retarded slightly. Thus, by not only adjusting the content of each of the components other than the essential components but also properly containing one or two or more kinds of these components other than the essential components, it is possible to make the marking layer more useful.

It has been understood from the foregoing results of the Example that the marking layer that the spark plug of the invention possesses has functions as a substitute of the glaze layer in the mode of overglaze while reducing the content of Pb. Also, it has been understood that the marking layer can be subjected to coloration in a varied color. For those reasons, it is possible to make the marking layer realize its appearance as a tint-rich design.

Also, after completion of all of the foregoing measurements, the cross section of each of the glaze layer that each of No. 1 to No. 46 of the Example possessed was subjected to EPMA analysis. As a result, it was confirmed that these glaze layers are constituted of a formulation substantially the same as in a glaze sample in which the foregoing glaze slurry was solidified in a block form. Incidentally, the Example and Example mode in this specification are merely one example, but it should not be construed that the invention is limited thereto.

This application is based on Japanese Patent application JP 2002-378843, filed Dec. 27, 2002, and Japanese Patent application JP 2003-367879, filed Oct. 28, 2003, the entire contents of those are hereby incorporated by reference, the same as if set forth at length.

What is claimed is:

1. A spark plug comprising an insulator, on at least a part of a surface of the insulator being formed a marking layer and a glaze layer, wherein the marking layer is exposed on the surface of the insulator and contains: a Pb component of not more than 5% by mole in terms of PbO; an Si component of from 36% by mole to 72% by mole in terms of $SiO_2$; an Al component of from 0.1% by mole to 18% by mole in terms of $Al_2O_3$; an alkali metal component containing at least one of an Li component, an Na component and a K component of from 0.1% by mole to 9% by mole in terms of $Li_2O$, $Na_2O$ and $K_2O$, respectively; a B component of from 3% by mole to 30% by mole in terms of $B_2O_3$; and a color developing component containing at least one of a V component, a Cr component, an Mn component, an Fe component, a Co component, an Ni component, a Cu component, a Pr component, an Nd component, an Au component, a Cd component, an Sn component, an Sb component, an Se component, an S component and an La component of more than 0% by mole but not more than 50% by mole in terms of $V_2O_5$, $Cr_2O_3$, $MnO_2$, $Fe_2O_3$, CoO, NiO, CuO, $Pr_2O_3$, $Nd_2O_3$, $Au_2O_3$, $Cd_2O_3$, $SnO_2$, $Sb_2O_5$, $SeO_2$, $SO_3$ and $La_2O_3$, respectively.

2. The spark plug according to claim 1, wherein the marking layer further contains a first alkaline earth metal component of at least one of an Mg component and a Ca component.

3. The spark plug according to claim 2, wherein a content of the first alkaline earth metal component in the marking layer is not more than 20% by mole in terms of MgO and CaO, respectively.

4. The spark plug according to claim 1, wherein the marking layer further contains a color development accelerating component of at least one of a Ti component and a Zr component.

5. The spark plug according to claim 4, wherein a content of the color development accelerating component in the marking layer is not more than 42% by mole in terms of $TiO_2$ and $ZrO_2$, respectively.

6. The spark plug according to claim 1, wherein the marking layer further contains a Zn component.

7. The spark plug according to claim 6, wherein a content of the Zn component in the marking layer is not more than 10% by mole in terms of ZnO.

8. The sparking plug according to claim 1, wherein the marking layer further contains a second alkaline earth metal component of at least one of an Sr component and a Ba component.

9. The spark plug according to claim 8, wherein a content of the second alkaline earth metal component in the marking layer is not more than 2% by mole in terms of SrO and BaO, respectively.

10. The spark plug according to claim 1, which comprises two or more of the marking layer having a different color from each other to provide the spark plug with a design of a pattern constructed of a plurality of colors.

* * * * *